US009040802B2

(12) United States Patent
Kakishita

(10) Patent No.: US 9,040,802 B2
(45) Date of Patent: May 26, 2015

(54) ACCOMPANIMENT DATA GENERATING APPARATUS

(75) Inventor: Masahiro Kakishita, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/982,476

(22) PCT Filed: Mar. 12, 2012

(86) PCT No.: PCT/JP2012/056267

§ 371 (c)(1),
(2), (4) Date: Jul. 29, 2013

(87) PCT Pub. No.: WO2012/132856

PCT Pub. Date: Oct. 4, 2012

(65) Prior Publication Data

US 2013/0305902 A1 Nov. 21, 2013

(30) Foreign Application Priority Data

Mar. 25, 2011 (JP) ..... 2011-067935
Mar. 25, 2011 (JP) ..... 2011-067936
Mar. 25, 2011 (JP) ..... 2011-067937

(51) Int. Cl.
*G10H 1/38* (2006.01)
*G10H 7/02* (2006.01)
*G10H 1/00* (2006.01)

(52) U.S. Cl.
CPC ..... *G10H 1/38* (2013.01); *G10H 2210/576* (2013.01); *G10H 7/02* (2013.01); *G10H 1/00* (2013.01); *G10H 2250/541* (2013.01); *G10H 2210/00* (2013.01)

(58) Field of Classification Search
USPC ..... 84/610, 613, 634, 638, 637, 650, 666, 84/669
See application file for complete search history.

(56) References Cited

U.S. PATENT DOCUMENTS 4,144,788 A * 3/1979 Bione et al. ..... 84/611
4,248,118 A * 2/1981 Hall et al. ..... 84/715
(Continued)

FOREIGN PATENT DOCUMENTS

JP 60-59392 A 4/1985
JP 2900753 B2 3/1999
(Continued)

OTHER PUBLICATIONS

International Search Report mailed May 15, 2012, for PCT Application No. PCT/JP2012/056267, filed Mar. 12, 2012, five pages.
(Continued)

*Primary Examiner* — David Warren
(74) *Attorney, Agent, or Firm* — Morrison & Foerster LLP

(57) ABSTRACT

An accompaniment data generating apparatus has a storing portion 15 for storing sets of phrase waveform data each related to a chord identified on the basis of a combination of chord type and chord root, and a CPU 9. The CPU 9 carries out a chord information obtaining process for obtaining chord information by which a chord type and a chord root are identified, and a chord note waveform data generating process for generating phrase waveform data indicative of chord notes of the chord root and the chord type identified by the obtained chord information in accordance with the obtained chord information by use of the sets of phrase waveform data stored in the storing portion 15, and outputting the generated data as accompaniment data.

30 Claims, 19 Drawing Sheets

| chord type table | | | |
|---|---|---|---|
| number | chord type | number | chord type |
| 01 | maj | 20 | mM7(♭5) |
| 02 | m | 21 | mM7 |
| 03 | 6 | 22 | mM7(9) |
| 04 | M7 | 23 | dim |
| 05 | M7(♭5) | 24 | dim7 |
| 06 | M7(♯11) | 25 | sus4 |
| 07 | add9 | 26 | sus2 |
| 08 | M7(9) | 27 | 7 |
| 09 | 6(9) | 28 | 7sus4 |
| 10 | ♭5 | 29 | 7(9) |
| 11 | aug | 30 | 7(♯11) |
| 12 | 7aug | 31 | 7(13) |
| 13 | M7aug | 32 | 7(♭5) |
| 14 | m6 | 33 | 7(♭9) |
| 15 | m7 | 34 | 7(♭13) |
| 16 | m7(♭5) | 35 | M7(♯9) |
| 17 | madd9 | 36 | 1+8 |
| 18 | m7(9) | 37 | 1+5 |
| 19 | m7(11) | | |

(56) References Cited

U.S. PATENT DOCUMENTS

| | | | | | |
|---|---|---|---|---|---|
| 4,315,451 | A | * | 2/1982 | Uchiyama et al. | 84/637 |
| 4,327,622 | A | * | 5/1982 | Aoki | 84/715 |
| 4,354,413 | A | * | 10/1982 | Suzuki et al. | 84/655 |
| 4,366,739 | A | * | 1/1983 | DeLong et al. | 84/713 |
| 4,417,494 | A | * | 11/1983 | Nakada et al. | 84/612 |
| 4,433,601 | A | * | 2/1984 | Hall et al. | 84/713 |
| 4,467,689 | A | * | 8/1984 | Stier et al. | 84/715 |
| 4,542,675 | A | * | 9/1985 | Hall et al. | 84/668 |
| 4,699,039 | A | * | 10/1987 | Oguri et al. | 84/622 |
| 4,864,907 | A | * | 9/1989 | Oguri | 84/637 |
| 4,876,937 | A | | 10/1989 | Suzuki | |
| 4,905,561 | A | * | 3/1990 | Mizuno | 84/613 |
| 4,922,797 | A | * | 5/1990 | Chapman | 84/650 |
| 4,939,974 | A | * | 7/1990 | Ishida et al. | 84/609 |
| 4,941,387 | A | * | 7/1990 | Williams et al. | 84/609 |
| 4,966,052 | A | * | 10/1990 | Shiraki et al. | 84/715 |
| 5,003,860 | A | * | 4/1991 | Minamitaka | 84/609 |
| 5,029,507 | A | * | 7/1991 | Bezeau, Jr. | 84/485 SR |
| 5,056,401 | A | * | 10/1991 | Yamaguchi et al. | 84/635 |
| 5,070,758 | A | * | 12/1991 | Katada et al. | 84/634 |
| 5,085,118 | A | * | 2/1992 | Sekizuka | 84/635 |
| 5,138,926 | A | * | 8/1992 | Stier et al. | 84/615 |
| 5,153,361 | A | * | 10/1992 | Kozuki | 84/613 |
| 5,179,241 | A | * | 1/1993 | Okuda et al. | 84/613 |
| 5,214,993 | A | * | 6/1993 | Konishi | 84/637 |
| 5,216,188 | A | * | 6/1993 | Shibukawa | 84/637 |
| 5,218,157 | A | * | 6/1993 | Akagawa et al. | 84/637 |
| 5,220,122 | A | * | 6/1993 | Shibukawa | 84/669 |
| 5,221,802 | A | * | 6/1993 | Konishi et al. | 84/637 |
| 5,223,659 | A | * | 6/1993 | Shiraki et al. | 84/669 |
| 5,235,126 | A | * | 8/1993 | Bruti et al. | 84/618 |
| 5,260,510 | A | * | 11/1993 | Shibukawa | 84/637 |
| 5,283,389 | A | * | 2/1994 | Matsuda | 84/637 |
| 5,294,747 | A | * | 3/1994 | Bruti et al. | 84/669 |
| 5,302,777 | A | * | 4/1994 | Okuda et al. | 84/637 |
| 5,322,966 | A | * | 6/1994 | Shimaya | 84/637 |
| 5,410,098 | A | * | 4/1995 | Ito | 84/613 |
| 5,412,156 | A | * | 5/1995 | Ikeda et al. | 84/635 |
| 5,477,003 | A | * | 12/1995 | Muraki et al. | 434/307 A |
| 5,481,066 | A | * | 1/1996 | Kitamura | 84/637 |
| 5,518,408 | A | * | 5/1996 | Kawashima et al. | 434/307 A |
| 5,559,299 | A | * | 9/1996 | Tajima | 84/610 |
| 5,563,361 | A | * | 10/1996 | Kondo et al. | 84/637 |
| 5,693,903 | A | * | 12/1997 | Heidorn et al. | 84/668 |
| 5,756,916 | A | * | 5/1998 | Aoki et al. | 84/619 |
| 5,811,707 | A | * | 9/1998 | Kakehashi et al. | 84/610 |
| 5,859,381 | A | * | 1/1999 | Takahashi et al. | 84/613 |
| 5,880,391 | A | * | 3/1999 | Westlund | 84/645 |
| 5,942,710 | A | * | 8/1999 | Hayakawa et al. | 84/637 |
| 5,962,802 | A | * | 10/1999 | Iizuka | 84/609 |
| 6,153,821 | A | * | 11/2000 | Fay et al. | 84/634 |
| 6,380,475 | B1 | * | 4/2002 | Kira | 84/637 |
| 6,410,839 | B2 | * | 6/2002 | Okubo et al. | 84/637 |
| 8,017,850 | B2 | * | 9/2011 | Kurebayashi | 84/609 |
| 8,338,686 | B2 | * | 12/2012 | Mann et al. | 84/609 |
| 8,710,343 | B2 | * | 4/2014 | Kellett et al. | 84/610 |
| 8,791,350 | B2 | * | 7/2014 | Okazaki | 84/610 |
| 2001/0003944 | A1 | * | 6/2001 | Okubo et al. | 84/637 |
| 2004/0112203 | A1 | | 6/2004 | Ueki et al. | |
| 2009/0064851 | A1 | * | 3/2009 | Morris et al. | 84/637 |
| 2010/0192755 | A1 | * | 8/2010 | Morris et al. | 84/637 |
| 2010/0224051 | A1 | * | 9/2010 | Kurebayashi | 84/637 |
| 2012/0312145 | A1 | * | 12/2012 | Kellett et al. | 84/613 |
| 2013/0025437 | A1 | * | 1/2013 | Serletic et al. | 84/634 |
| 2013/0047821 | A1 | * | 2/2013 | Okazaki | 84/605 |
| 2013/0305902 | A1 | * | 11/2013 | Okazaki et al. | 84/604 |
| 2013/0305907 | A1 | * | 11/2013 | Kakishita | 84/613 |

FOREIGN PATENT DOCUMENTS

| | | | |
|---|---|---|---|
| JP | 2006-126697 | A | 5/2006 |
| JP | 4274272 | B2 | 3/2009 |
| JP | 2009-156914 | A | 7/2009 |
| WO | WO-2009/032794 | A1 | 3/2009 |

OTHER PUBLICATIONS

Bhaskar M., et al. (Nov. 29, 2010). "A Music Based Harmony Search (MBHS) Approach to Optimal Power Flow with Reactive Power Loss Optimization," Power and Energy (PECON), 2010 IEEE, International Conference on IEEE, Piscataway, NJ, USA, five pages.

Lemouton, S. et al. (Jan. 1, 2006). "knitting and Weaving: Using OpenMusic to Generate Canonic Musical Material," located at: <http://repmus.ircam.fr/media/bresson/enseicinement/lemouton-schaathun-ombook.pdf>, retrieved on Aug. 18, 2014, ten pages.

Supplemental Partial European Search Report mailed Jan. 20, 2015, for EP Application No. 12765940.7, seven pages.

* cited by examiner

FIG.3

| chord type table | | | |
|---|---|---|---|
| number | chord type | number | chord type |
| 01 | maj | 20 | mM7(♭5) |
| 02 | m | 21 | mM7 |
| 03 | 6 | 22 | mM7(9) |
| 04 | M7 | 23 | dim |
| 05 | M7(♭5) | 24 | dim7 |
| 06 | M7(♯11) | 25 | sus4 |
| 07 | add9 | 26 | sus2 |
| 08 | M7(9) | 27 | 7 |
| 09 | 6(9) | 28 | 7sus4 |
| 10 | ♭5 | 29 | 7(9) |
| 11 | aug | 30 | 7(♯11) |
| 12 | 7aug | 31 | 7(13) |
| 13 | M7aug | 32 | 7(♭5) |
| 14 | m6 | 33 | 7(♭9) |
| 15 | m7 | 34 | 7(♭13) |
| 16 | m7(♭5) | 35 | M7(♯9) |
| 17 | madd9 | 36 | 1+8 |
| 18 | m7(9) | 37 | 1+5 |
| 19 | m7(11) | | |

FIG.13

| chord type | root | third | fifth | fourth note |
|---|---|---|---|---|
| maj | 0 | 4 | 7 | – |
| 6 | 0 | 4 | 7 | 9 |
| M7 | 0 | 4 | 7 | 11 |
| m | 0 | 3 | 7 | – |
| m6 | 0 | 3 | 7 | 9 |
| m7 | 0 | 3 | 7 | 10 |
| mM7 | 0 | 3 | 7 | 11 |
| 7 | 0 | 4 | 7 | 10 |
| M7(♭5) | 0 | 4 | 6 | 11 |
| ♭5 | 0 | 4 | 6 | – |
| m7(♭5) | 0 | 3 | 6 | 10 |
| mM7(♭5) | 0 | 3 | 6 | 11 |
| 7(♭5) | 0 | 4 | 6 | 10 |
| aug | 0 | 4 | 8 | – |
| 7aug | 0 | 4 | 8 | 10 |
| M7aug | 0 | 4 | 8 | 11 |
| dim | 0 | 3 | 6 | – |
| dim7 | 0 | 3 | 6 | 9 |
| sus4 | 0 | 5 | 7 | – |
| 7sus4 | 0 | 5 | 7 | 10 |
| 1+8 | 0 | – | – | – |
| 1+5 | 0 | – | 7 | – |

ACCOMPANIMENT DATA GENERATING APPARATUS

CROSS-REFERENCE TO RELATED APPLICATIONS

This application is a National Phase application under 35 U.S.C. §371 of International Application No. PCT/JP2012/056267 filed Mar. 12, 2012, which claims priority benefit of Japanese Patent Application No. 2011-067935 filed Mar. 25, 2011, Japanese Patent Application No. 2011-067936 filed Mar. 25, 2011 and Japanese Patent Application No. 2011-067937 filed Mar. 25, 2011. The contents of the above applications are herein incorporated by reference in their entirety for all intended purposes.

BACKGROUND OF THE INVENTION

1. Field of the Invention

The present invention relates to an accompaniment data generating apparatus and an accompaniment data generation program for generating waveform data indicative of chord tone phrases.

2. Description of the Related Art

Conventionally, there is a known automatic accompaniment apparatus which stores sets of accompaniment style data based on automatic performance data such as MIDI format available in various music styles (genres), and adds accompaniment to user's musical performance in accordance with user's (performer's) selected accompaniment style data (see Japanese Patent Publication No. 2900753, for example).

The conventional automatic accompaniment apparatus which uses automatic musical performance data converts tone pitches so that, for example, accompaniment style data based on a certain chord such as CMaj will match chord information detected from user's musical performance.

Furthermore, there is a known arpeggio performance apparatus which stores arpeggio pattern data as phrase waveform data, adjusts tone pitch and tempo to match user's input performance, and generates automatic accompaniment data (see Japanese Patent Publication No. 4274272, for example).

Because the above-described automatic accompaniment apparatus which uses automatic performance data generates musical tones by use of MIDI or the like, it is difficult to perform automatic accompaniment in which musical tones of an ethnic musical instrument or a musical instrument using a peculiar scale are used. In addition, because the above-described automatic accompaniment apparatus offers accompaniment based on automatic performance data, it is difficult to exhibit realism of human live performance.

Furthermore, the conventional automatic accompaniment apparatus which uses phrase waveform data such as the above-described arpeggio performance apparatus is able to provide automatic performance only of accompaniment phrases of monophony.

SUMMARY OF THE INVENTION

An object of the present invention is to provide an accompaniment data generating apparatus which can generate automatic accompaniment data that uses phrase waveform data including chords.

In order to achieve the above-described object, it is a feature of the present invention to provide an accompaniment data generating apparatus including a storing portion (15) for storing sets of phrase waveform data each related to a chord identified on the basis of a combination of chord type and chord root; a chord information obtaining portion (SA18, SA19) for obtaining chord information which identifies chord type and chord root; and a chord note phrase generating portion (SA10, SA21 to SA23, SA31, SA32, SB2 to SB8, SC2 to SC26) for generating waveform data indicative of a chord note phrase corresponding to a chord identified on the basis of the obtained chord information as accompaniment data by use of the phrase waveform data stored in the storing portion.

As the first concrete example, the each set of phrase waveform data related to a chord is phrase waveform data indicative of chord notes obtained by combining notes which form the chord.

In this case, the storing portion may store the sets of phrase waveform data indicative of chord notes such that a set of phrase waveform data is provided for each chord type; and the chord note phrase generating portion may include a reading portion (SA10, SA21, SA22) for reading out, from the storing portion, a set of phrase waveform data indicative of chord notes corresponding to a chord type identified on the basis of the chord information obtained by the chord information obtaining portion; and a pitch-shifting portion (SA23) for pitch-shifting the read set of phrase waveform data indicative of the chord notes in accordance with a difference in tone pitch between a chord root identified on the basis of the obtained chord information and a chord root of the chord notes indicated by the read set of phrase waveform data, and generating waveform data indicative of a chord note phrase.

Furthermore, the storing portion may store the sets of phrase waveform data indicative of notes of chords whose chord roots are various tone pitches such that the phrase waveform data is provided for each chord type; and the chord note phrase generating portion may include a reading portion (SA10, SA21, SA22) for reading out, from the storing portion, a set of phrase waveform data which corresponds to a chord type identified on the basis of the chord information obtained by the chord information obtaining portion and indicates notes of a chord whose chord root has the smallest difference in tone pitch between a chord root identified on the basis of the obtained chord information; and a pitch-shifting portion (SA23) for pitch-shifting the read set of phrase waveform data indicative of the chord notes in accordance with the difference in tone pitch between the chord root identified on the basis of the obtained chord information and the chord root of the chord indicated by the read set of phrase waveform data, and generating waveform data indicative of a chord note phrase.

Furthermore, the storing portion may store the sets of phrase waveform data indicative of chord notes such that the phrase waveform data is provided for each chord root of each chord type; and the chord note phrase generating portion may include a reading portion (SA10, SA21 to SA23) for reading out, from the storing portion, a set of phrase waveform data indicative of notes of a chord which corresponds to a chord type and a chord root identified on the basis of the chord information obtained by the chord information obtaining portion, and generating waveform data indicative of a chord note phrase.

As the second concrete example, furthermore, the each set of phrase waveform data related to a chord is formed of a set of basic phrase waveform data which is applicable to a plurality of chord types and includes phrase waveform data indicative of at least a chord root note; and a plurality of selective phrase waveform data sets which are phrase waveform data indicative of a plurality of chord notes (and notes other than the chord notes) whose chord root is the chord root indicated by the set of basic phrase waveform data and each of which is applicable to a different chord type and which are not included in the set of basic phrase waveform data; and the chord note phrase generating portion reads out the basic phrase waveform data and the selective phrase waveform data from the storing portion, combines the read data, and generates waveform data indicative of a chord note phrase.

In this case, the chord note phrase generating portion may include a first reading portion (SA10, SA31, SB2, SB4, SB5) for reading out the basic phrase waveform data, from the storing portion, and pitch-shifting the read basic phrase waveform data in accordance with a difference in tone pitch between the chord root identified on the basis of the chord information obtained by the chord information obtaining portion and the chord root of the read basic phrase waveform data; a second reading portion (SA10, SA31, SB2, SB4, SB6 to SB8) for reading out the selective phrase waveform data corresponding to the chord type identified on the basis of the obtained chord information, and pitch-shifting the read selective phrase waveform data in accordance with the difference in tone pitch between the chord root identified on the basis of the obtained chord information and the chord root of the read set of basic phrase waveform data; and a combining portion (SA31, SB5, SB8) for combining the read and pitch-shifted basic phrase waveform data and the read and pitch-shifted selective phrase waveform data, and generating waveform data indicative of a chord note phrase.

Furthermore, the chord note phrase generating portion may include a first reading portion (SA10, SA31, SB2, SB5) for reading out the basic phrase waveform data from the storing portion; a second reading portion (SA10, SA31, SB2, SB6 to SB8) for reading out, from the storing portion, the selective phrase waveform data corresponding to the chord type identified on the basis of the chord information obtained by the chord information obtaining portion; and a combining portion (SA31, SB4, SB5, SB8) for combining the read basic phrase waveform data and the read selective phrase waveform data, pitch-shifting the combined phrase waveform data in accordance with a difference in tone pitch between the chord root identified on the basis of the obtained chord information and the chord root of the read basic phrase waveform data, and generating waveform data indicative of a chord note phrase.

Furthermore, the storing portion may store groups of the set of basic phrase waveform data and the sets of selective phrase waveform data, each of the groups having a different chord root; and the chord note phrase generating portion may include a selecting portion (SB2) for selecting a group of the basic phrase waveform data set and selective phrase waveform data sets having a chord root of a tone pitch having the smallest difference in tone pitch between the chord root identified on the basis of the chord information obtained by the chord information obtaining portion; a first reading portion (SA10, SA31, SB2, SB4, SB5) for reading out the basic phrase waveform data included in the selected group of basic phrase waveform data set and selective phrase waveform data sets from the storing portion, and pitch-shifting the read basic phrase waveform data in accordance with a difference in tone pitch between the chord root identified on the basis of the obtained chord information and the chord root of the read basic phrase waveform data set; a second reading portion (SA10, SA31, SB2, SB4, SB6 to SB8) for reading out, from the storing portion, the selective phrase waveform data which is included in the selected group of basic phrase waveform data set and selective phrase waveform data sets and corresponds to the chord type identified on the basis of the obtained chord information, and pitch-shifting the read selective phrase waveform data in accordance with the difference in tone pitch between the chord root identified on the basis of the obtained chord information and the chord root of the read basic phrase waveform data set; and a combining portion (SA31, SB5, SB8) for combining the read and pitch-shifted basic phrase waveform data and the read and pitch-shifted selective phrase waveform data, and generating waveform data indicative of a chord note phrase.

Furthermore, the storing portion may store groups of the set of basic phrase waveform data and the sets of selective phrase waveform data, each of the groups having a different chord root; and the chord note phrase generating portion may include a selecting portion (SB2) for selecting a group of the basic phrase waveform data set and selective phrase waveform data sets having a chord root of a tone pitch having the smallest difference in tone pitch between the chord root identified on the basis of the chord information obtained by the chord information obtaining portion; a first reading portion (SA10, SA31, SB2, SB5) for reading out the basic phrase waveform data included in the selected group of basic phrase waveform data set and selective phrase waveform data sets from the storing portion; a second reading portion (SA10, SA31, SB2, SB6 to SB8) for reading out, from the storing portion, the selective phrase waveform data which is included in the selected group of basic phrase waveform data set and selective phrase waveform data sets and corresponds to the chord type identified on the basis of the obtained chord information; and a combining portion (SA31, SB4, SB5, SB8) for combining the read basic phrase waveform data and the read selective phrase waveform data, pitch-shifting the combined phrase waveform data in accordance with a difference in tone pitch between the chord root identified on the basis of the obtained chord information and the chord root of the read basic phrase waveform data, and generating waveform data indicative of a chord note phrase.

Furthermore, the storing portion may store the set of basic phrase waveform data and the sets of selective phrase waveform data for each chord root; and the chord note phrase generating portion may include a first reading portion (SA10, SA31, SB2, SB5) for reading out, from the storing portion, basic phrase waveform data corresponding to the chord root identified on the basis of the chord information obtained by the chord information obtaining portion; a second reading portion (SA10, SA31, SB2, SB6 to SB8) for reading out, from the storing portion, the selective phrase waveform data corresponding to the chord root and the chord type identified on the basis of the obtained chord information; and a combining portion (SA31, SB5, SB8) for combining the read basic phrase waveform data and the read selective phrase waveform data, and generating waveform data indicative of a chord note phrase.

Furthermore, the set of basic phrase waveform data is a set of phrase waveform data indicative of notes obtained by combining the chord root of the chord and a note which constitutes the chord and can be applicable to the chord types but is not the chord root.

As the third concrete example, furthermore, each of the sets of phrase waveform data each related to a chord may be formed of a set of basic phrase waveform data which is phrase waveform data indicative of a chord root note; and sets of selective phrase waveform data which are phrase waveform data indicative of part of chord notes whose chord root is the chord root indicated by the basic phrase waveform data, and which are applicable to a plurality of chord types and indicate the part of the chord notes which are different from the chord root note indicated by the basic phrase waveform data; and the chord note phrase generating portion may read out the basic phrase waveform data and the selective phrase waveform data from the storing portion, pitch-shift the read selective phrase waveform data in accordance with the chord type identified on the basis of the chord information obtained by the chord information obtaining portion, combine the read basic phrase waveform data and the read and pitch-shifted selective phrase waveform data, and generate waveform data indicative of a chord note phrase.

Furthermore, the chord note phrase generating portion may include a first reading portion (SA10, SA31, SC2, SC4, SC5) for reading out the basic phrase waveform data from the storing portion and pitch-shifting the read basic phrase waveform data in accordance with a difference in tone pitch between the chord root identified on the basis of the chord information obtained by the chord information obtaining portion and the chord root of the read basic phrase waveform data; a second reading portion (SA10, SA31, SC2, SC4, SC6 to SC12, SC13 to SC19, SC20 to SC26) for reading out the selective phrase waveform data from the storing portion in accordance with the chord type identified on the basis of the obtained chord information, and pitch-shifting the read selective phrase waveform data in accordance not only with the difference in tone pitch between the chord root identified on the basis of the obtained chord information and the chord root of the read basic phrase waveform data but also with a difference in tone pitch between a note of a chord corresponding to the chord type identified on the basis of the obtained chord information and a note of a chord indicated by the read selective phrase waveform data; and a combining portion (SC5, SC12, SC19, SC26) for combining the read and pitch-shifted basic phrase waveform data and the read and pitch-shifted selective phrase waveform data and generating waveform data indicative of a chord note phrase.

Furthermore, the chord note phrase generating portion may include a first reading portion (SA10, SA31, SC2, SC5) for reading out the basic phrase waveform data from the storing portion; a second reading portion (SA10, SA31, SC6 to SC12, SC13 to SC19, SC20 to SC26) for reading out, from the storing portion, the selective phrase waveform data in accordance with the chord type identified on the basis of the chord information obtained by the chord information obtaining portion, and pitch-shifting the read selective phrase waveform data in accordance with a difference in tone pitch between a chord note corresponding to the chord type identified on the basis of the obtained chord information and a chord note indicated by the read selective phrase waveform data; and a combining portion (SC4, SC5, SC12, SC19, SC26) for combining the read basic phrase waveform data and the read and pitch-shifted selective phrase waveform data, pitch-shifting the combined phrase waveform data in accordance with a difference in tone pitch between the chord root identified on the basis of the obtained chord information and the chord root indicated by the read basic phrase waveform data, and generating waveform data indicative of a chord note phrase.

Furthermore, the storing portion may store groups of the set of basic phrase waveform data and the sets of selective phrase waveform data, each of the groups having a different chord root; and the chord note phrase generating portion may include a selecting portion (SC2) for selecting a group of the basic phrase waveform data set and selective phrase waveform data sets having a chord root of a tone pitch having the smallest difference in tone pitch between the chord root identified on the basis of the chord information obtained by the chord information obtaining portion; a first reading portion (SA10, SA31, SC2, SC4, SC5) for reading out the basic phrase waveform data set included in the selected group of basic phrase waveform data set and selective phrase waveform data sets from the storing portion, and pitch-shifting the read basic phrase waveform data in accordance with a difference in tone pitch between the chord root identified on the basis of the obtained chord information and the chord root of the read basic phrase waveform data; a second reading portion (SA10, SA31, SC2, SC4, SC6 to SC12, SC13 to SC19, SC20 to SC26) for reading out, from the storing portion, selective phrase waveform data which is included in the selected group of basic phrase waveform data set and selective phrase waveform data sets and is applicable to the chord type identified on the basis of the obtained chord information, and pitch-shifting the read selective phrase waveform data in accordance not only with the difference in tone pitch between the chord root identified on the basis of the obtained chord information and the chord root of the read basic phrase waveform data but also with a difference in tone pitch between a note of a chord corresponding to the chord type identified on the basis of the obtained chord information and a note of a chord indicated by the read selective phrase waveform data; and a combining portion (SC5, SC12, SC19, SC26) for combining the read and pitch-shifted basic phrase waveform data and the read and pitch-shifted selective phrase waveform data, and generating waveform data indicative of a chord note phrase.

Furthermore, the storing portion may store groups of the set of basic phrase waveform data and the sets of selective phrase waveform data, each of the groups having a different chord root; and the chord note phrase generating portion may include a selecting portion (SC2) for selecting a group of the basic phrase waveform data set and selective phrase waveform data sets having a chord root of a tone pitch having the smallest difference in tone pitch between the chord root identified on the basis of the chord information obtained by the chord information obtaining portion; a first reading portion (SA10, SA31, SC2, SC5) for reading out the basic phrase waveform data set included in the selected group of basic phrase waveform data set and selective phrase waveform data sets from the storing portion; a second reading portion (SA10, SA31, SC6 to SC12, SC13 to SC19, SC20 to SC26) for reading out, from the storing portion, selective phrase waveform data which is included in the selected group of basic phrase waveform data set and selective phrase waveform data sets and is applicable to the chord type identified on the basis of the obtained chord information, and pitch-shifting the read selective phrase waveform data in accordance with a difference in tone pitch between a chord note corresponding to the chord type identified on the basis of the obtained chord information and a chord note indicated by the read selective phrase waveform data; and a combining portion (SC4, SC5, SC12, SC19, SC26, SA32) for combining the read basic phrase waveform data and the read and pitch-shifted selective phrase waveform data, pitch-shifting the combined phrase waveform data in accordance with a difference in tone pitch between the chord root identified on the basis of the obtained chord information and the chord root indicated by the read basic phrase waveform data, and generating waveform data indicative of a chord note phrase.

Furthermore, the storing portion may store the set of basic phrase waveform data and the sets of selective phrase waveform data for each chord root; and the chord note phrase generating portion may include a first reading portion (SA10, SA31, SC2, SC5) for reading out, from the storing portion, basic phrase waveform data corresponding to the chord root identified on the basis of the chord information obtained by the chord information obtaining portion; a second reading portion (SA10, SA31, SC6 to SC12, SC13 to SC19, SC20 to SC26) for reading out, from the storing portion, selective phrase waveform data in accordance with the chord root and the chord type identified on the basis of the obtained chord information, and pitch-shifting the read selective phrase waveform data in accordance with a difference in tone pitch between a chord note corresponding to the chord type identified on the basis of the obtained chord information and a chord note indicated by the read selective phrase waveform data; and a combining portion (SC5, SC12, SC19, SC26) for combining the read basic phrase waveform data and the read and pitch-shifted selective phrase waveform data, and generating waveform data indicative of a chord note phrase.

Furthermore, the selective phrase waveform data sets are phrase waveform data sets corresponding to at least a note having an interval of a third and a note having an interval of a fifth included in a chord.

Furthermore, the phrase waveform data may be obtained by recording musical tones corresponding to a musical performance of an accompaniment phrase having a predetermined number of measures.

According to the present invention, the accompaniment data generating apparatus is able to generate automatic accompaniment data which uses phrase waveform data including chords.

Furthermore, the present invention is not limited to the invention of the accompaniment data generating apparatus, but can be also embodied as inventions of an accompaniment data generating method and an accompaniment data generation program.

BRIEF DESCRIPTION OF THE DRAWINGS

FIG. 3 is a conceptual diagram indicative of an example chord type table according to the first embodiment of the present invention;

FIG. 13 is a conceptual diagram indicative of an example chord type-organized semitone distance table according to the third embodiment of the present invention;

DESCRIPTION OF THE PREFERRED EMBODIMENT a. First Embodiment

Figure 1:
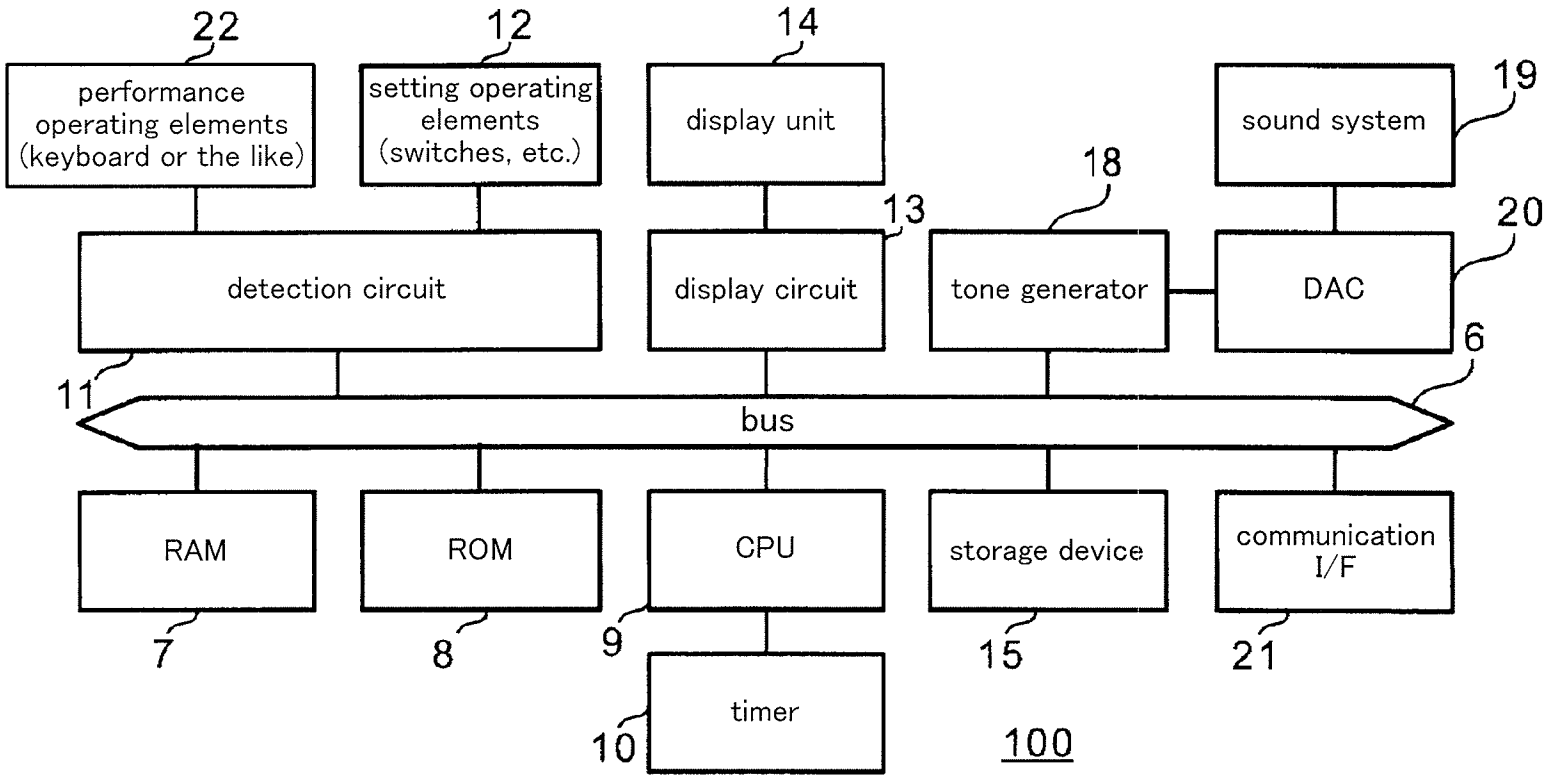
FIG. 1 is a block diagram indicative of an example hardware configuration of an accompaniment data generating apparatus according to first to third embodiments of the present invention.

The first embodiment of the present invention will be explained. FIG. 1 is a block diagram indicative of an example of a hardware configuration of an accompaniment data generating apparatus 100 according to the first embodiment of the present invention.

A RAM 7, a ROM 8, a CPU 9, a detection circuit 11, a display circuit 13, a storage device 15, a tone generator 18 and a communication interface (I/F) 21 are connected to a bus 6 of the accompaniment data generating apparatus 100.

The RAM 7 has a working area for the CPU 9 such as buffer areas including reproduction buffer and registers in order to store flags, various parameters and the like. For example, automatic accompaniment data which will be described later is to be loaded into an area of the RAM 7.

In the ROM 8, various kinds of data files (later-described automatic accompaniment data AA, for instance), various kinds of parameters, control programs, and programs for realizing the first embodiment can be stored. In this case, there is no need to doubly store the programs and the like in the storage device 15.

The CPU 9 performs computations, and controls the apparatus in accordance with the control programs and programs for realizing the first embodiment stored in the ROM 8 or the storage device 15. A timer 10 is connected to the CPU 9 to supply basic clock signals, interrupt timing and the like to the CPU 9.

A user uses setting operating elements 12 connected to the detection circuit 11 for various kinds of input, setting and selection. The setting operating elements 12 can be anything such as switch, pad, fader, slider, rotary encoder, joystick, jog shuttle, keyboard for inputting characters and mouse, as long as they are able to output signals corresponding to user's inputs. Furthermore, the setting operating elements 12 may be software switches which are displayed on a display unit 14 to be operated by use of operating elements such as cursor switches.

By using the setting operating elements 12, in the first embodiment, the user selects automatic accompaniment data AA stored in the storage device 15, the ROM 8 or the like, or retrieved (downloaded) from an external apparatus through the communication I/F 21, instructs to start or stop automatic accompaniment, and makes various settings.

The display circuit 13 is connected to the display unit 14 to display various kinds of information on the display unit 14. The display unit 14 can display various kinds of information for the settings on the accompaniment data generating apparatus 100.

The storage device 15 is formed of at least one combination of a storage medium such as a hard disk, FD (flexible disk or floppy disk (trademark)), CD (compact disk), DVD (digital versatile disk), or semiconductor memory such as flash memory and its drive. The storage media can be either detachable or integrated into the accompaniment data generating apparatus 100. In the storage device 15 and(or) the ROM 8, preferably a plurality of automatic accompaniment data sets AA, and the programs for realizing the first embodiment of the present invention and the other control programs can be stored. In a case where the programs for realizing the first embodiment of the present invention and the other control programs are stored in the storage device 15, there is no need to store these programs in the ROM 8 as well. Furthermore, some of the programs can be stored in the storage device 15, with the other programs being stored in the ROM 8.

The tone generator 18 is a waveform memory tone generator, for example, which is a hardware or software tone generator that is capable of generating musical tone signals at least on the basis of waveform data (phrase waveform data). The tone generator 18 generates musical tone signals in accordance with automatic accompaniment data or automatic performance data stored in the storage device 15, the ROM 8, the RAM 7 or the like, or performance signals, MIDI signals, phrase waveform data or the like supplied from performance operating elements (keyboard) 22 or an external apparatus connected to the communication interface 21, adds various musical effects to the generated signals and supplies the signals to a sound system 19 through a DAC 20. The DAC 20 converts supplied digital musical tone signals into analog signals, while the sound system 19 which includes amplifiers and speakers emits the D/A converted musical tone signals as musical tones.

The communication interface 21, which is formed of at least one of a communication interface such as general-purpose wired short distance I/F such as USB and IEEE 1394, and a general-purpose network I/F such as Ethernet (trademark), a communication interface such as a general-purpose I/F such as MIDI I/F and a general-purpose short distance wireless I/F such as wireless LAN and Bluetooth (trademark), and a music-specific wireless communication interface, is capable of communicating with an external apparatus, a server and the like.

The performance operating elements (keyboard or the like) 22 are connected to the detection circuit 11 to supply performance information (performance data) in accordance with user's performance operation. The performance operating elements 22 are operating elements for inputting user's musical performance. More specifically, in response to user's operation of each performance operating element 22, a key-on signal or a key-off signal indicative of timing at which user's operation of the corresponding performance operating element 22 starts or finishes, respectively, and a tone pitch corresponding to the operated performance operating element 22 are input. By use of the musical performance operating element 22, in addition, various kinds of parameters such as a velocity value corresponding to the user's operation of the musical performance operating element 22 for musical performance can be input.

The musical performance information input by use of the musical performance operating elements (keyboard or the like) 22 includes chord information which will be described later or information for generating chord information. The chord information can be input not only by the musical performance operating elements (keyboard or the like) 22 but also by the setting operating elements 12 or an external apparatus connected to the communication interface 21.

Figure 2:
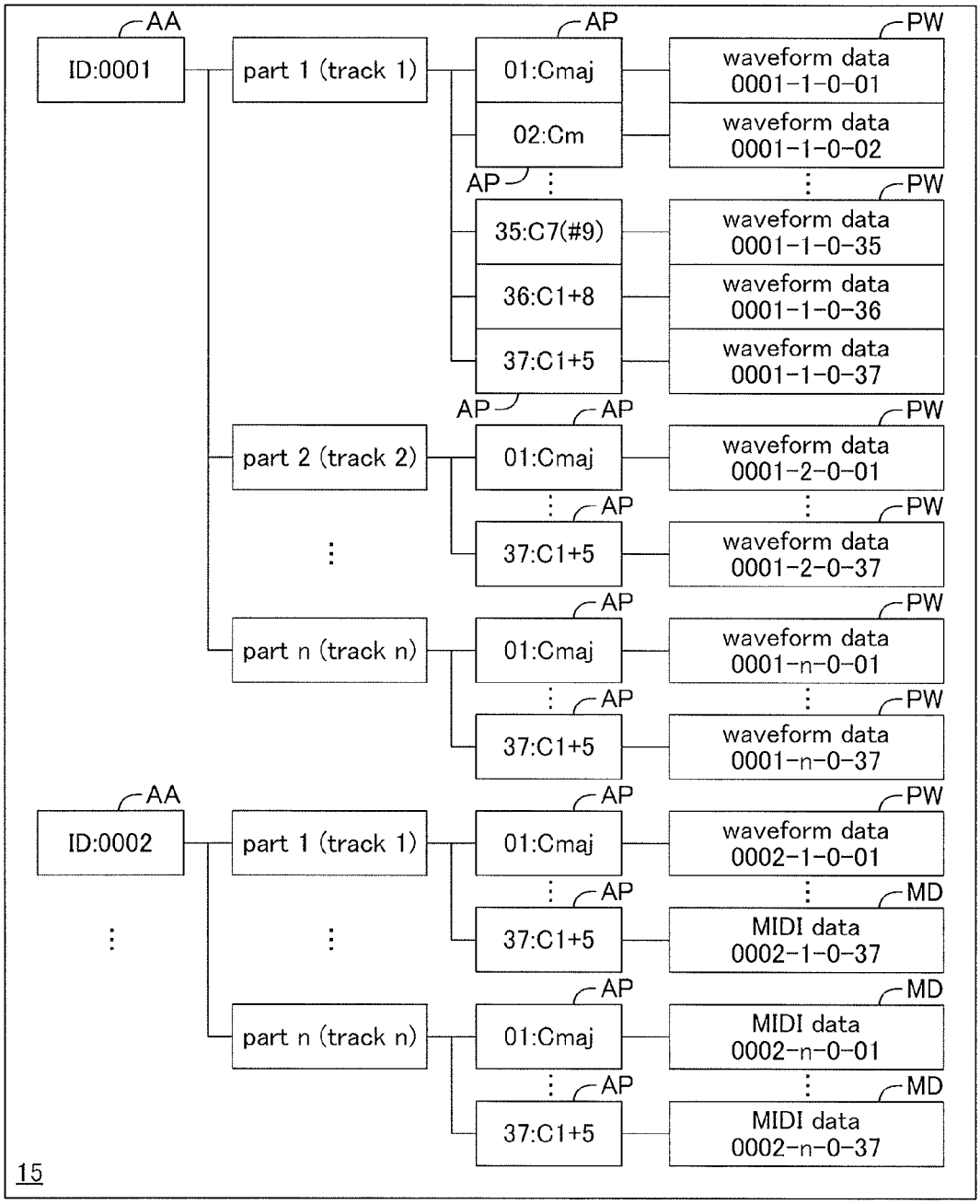
FIG. 2 is a conceptual diagram indicative of an example configuration of automatic accompaniment data used in the first embodiment of the present invention.

FIG. 2 is a conceptual diagram indicative of an example configuration of the automatic accompaniment data AA used in the first embodiment of the present invention.

The automatic accompaniment data AA according to the first embodiment of the invention is data for performing, when the user plays a melody line with the musical performance operating elements 22 indicated in FIG. 1, for example, automatic accompaniment of at least one part (track) in accordance with the melody line.

In this embodiment, sets of automatic accompaniment data AA are provided for each of various music genres such as jazz, rock and classic. The sets of automatic accompaniment data AA can be identified by identification number (ID number), accompaniment style name or the like. In this embodiment, sets of automatic accompaniment data AA are stored in the storage device 15 or the ROM 8 indicated in FIG. 1, for example, with each automatic accompaniment data set AA being given an ID number (e.g., "0001", "0002" or the like).

The automatic accompaniment data AA is generally provided for each accompaniment style classified according to rhythm type, musical genre, tempo and the like. Furthermore, each automatic accompaniment data set AA contains a plurality of sections provided for a song such as intro, main, fill-in and ending. Furthermore, each section is configured by a plurality of tracks such as chord track, base track and drum (rhythm) track. For convenience in explanation, however, it is assumed in the first embodiment that the automatic accompaniment data set AA is configured by a section having a plurality of parts (part 1 (track 1) to part n (track n)) including at least a chord track for accompaniment which uses chords.

Each part of the parts 1 to n (tracks 1 to n) of the automatic accompaniment data set AA is correlated with sets of accompaniment pattern data AP. Each accompaniment pattern data set AP is correlated with one chord type with which at least a set of phrase waveform data PW is correlated. In the first embodiment, as indicated in a table shown in FIG. 3, accompaniment pattern data supports 37 different kinds of chord types such as major chord (Maj), minor chord (m) and seventh chord (7). More specifically, each of the parts 1 to n (track 1 to n) of a set of automatic accompaniment data AA stores accompaniment pattern data sets AP of 37 different kinds. Available chord types are not limited to the 37 kinds indicated in FIG. 3 but can be increased/decreased as desired. Furthermore, available chord types may be specified by a user.

In a case where a set of automatic accompaniment data AA has a plurality of parts (tracks), although at least one of the parts has to have accompaniment pattern data AP with which phrase waveform data PW is correlated, the other parts may be correlated with accompaniment phrase data based on automatic musical performance data such as MIDI. As in the case of a set of automatic accompaniment data AA having the ID number "0002" indicated in FIG. 2, for example, some of accompaniment pattern data sets AP of the part 1 may be correlated with phrase waveform data PW, with the other accompaniment pattern data sets AP being correlated with MIDI data MD, whereas all the accompaniment pattern data sets AP of the part n may be correlated with MIDI data MD.

A set of phrase waveform data PW is phrase waveform data which stores musical tones corresponding to the performance of an accompaniment phrase based on a chord type and a chord root with which a set of accompaniment data AP correlated with the phrase waveform data set PW is correlated. The set of phrase waveform data PW has the length of one or more measures. For instance, a set of phrase waveform data PW based on CMaj is waveform data in which musical tones (including accompaniment other than chord accompaniment) played mainly by use of tone pitches C, E and G which form the C major chord are digitally sampled and stored. Furthermore, there can be sets of phrase waveform data PW each of which includes tone pitches (which are not the chord notes) other than the notes which form the chord (the chord specified by a combination of a chord type and a chord root) on which the phrase waveform data set PW is based. Furthermore, each set of phrase waveform data PW has an identifier by which the phrase waveform data set PW can be identified.

In the first embodiment, each set of phrase waveform data PW has an identifier having a form "ID (style number) of automatic accompaniment data AA-part (track) number-number indicative of a chord root-chord type number (see FIG. 3)". In the first embodiment, the identifiers are used as chord type information for identifying chord type and chord root information for identifying root (chord root) of a set of phrase waveform data PW. By referring to the identifier of a set of phrase waveform data PW, therefore, a chord type and a chord root on which the phrase waveform data PW is based can be obtained. By employing a manner other than the above-described manner in which identifiers are used, information about chord type and chord root may be provided for each set of phrase waveform data PW.

Figure 4:
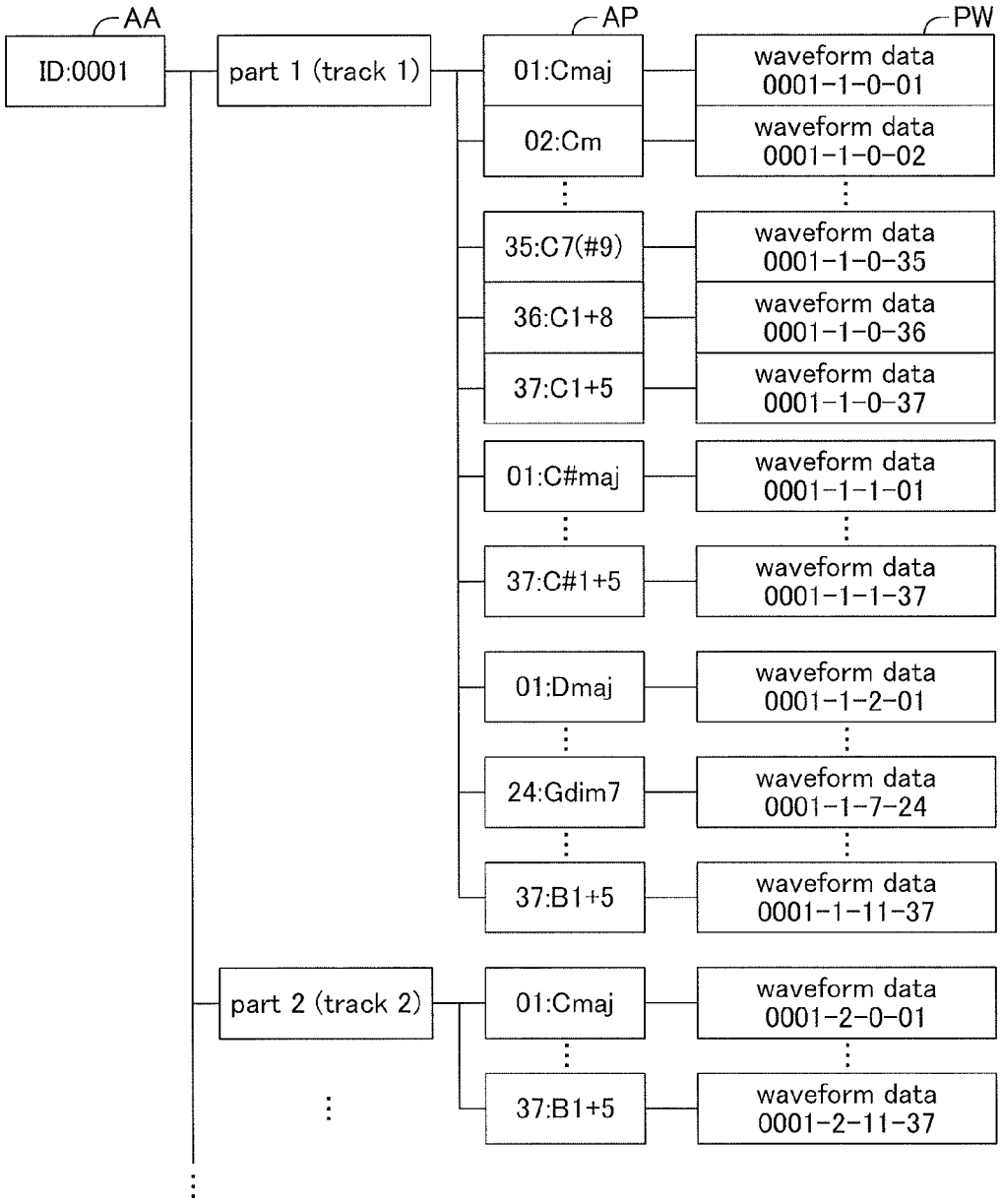
FIG. 4 is a conceptual diagram indicative of a different example configuration of automatic accompaniment data used in the first embodiment of the present invention.

In this embodiment, a chord root "C" is provided for each set of phrase waveform data PW. However, the chord root is not limited to "C" and may be any note. Furthermore, sets of phrase waveform data PW may be provided to correlate with a plurality of chord roots (2 to 12) for one chord type. In a case where sets of phrase waveform data PW are provided for each chord root (12 notes) as indicated in FIG. 4, later-described processing for pitch shift is not necessary.

The automatic accompaniment data AA includes not only the above-described information but also information about settings of the entire automatic accompaniment data including name of accompaniment style, time information, tempo information (recording (reproduction) tempo of phrase waveform data PW), information about parts of the automatic accompaniment data. In a case where a set of automatic accompaniment data AA is formed of a plurality of sections, furthermore, the automatic accompaniment data set AA includes the names and the number of measures (e.g., 1 measure, 4 measures, 8 measures, or the like) of the sections (intro, main, ending, and the like).

Although the first embodiment is designed such that each part has sets of accompaniment pattern data AP (phrase waveform data PW) corresponding to a plurality of chord types, the embodiment may be modified such that each chord type has sets of accompaniment pattern data AP (phrase waveform data PW) corresponding to a plurality of parts.

Furthermore, the sets of phrase waveform data PW may be stored in the automatic accompaniment data AA. Alternatively, the sets of phrase waveform data PW may be stored separately from the automatic accompaniment data AA which stores only information indicative of links to the phrase waveform data sets PW.

Figure 5A:
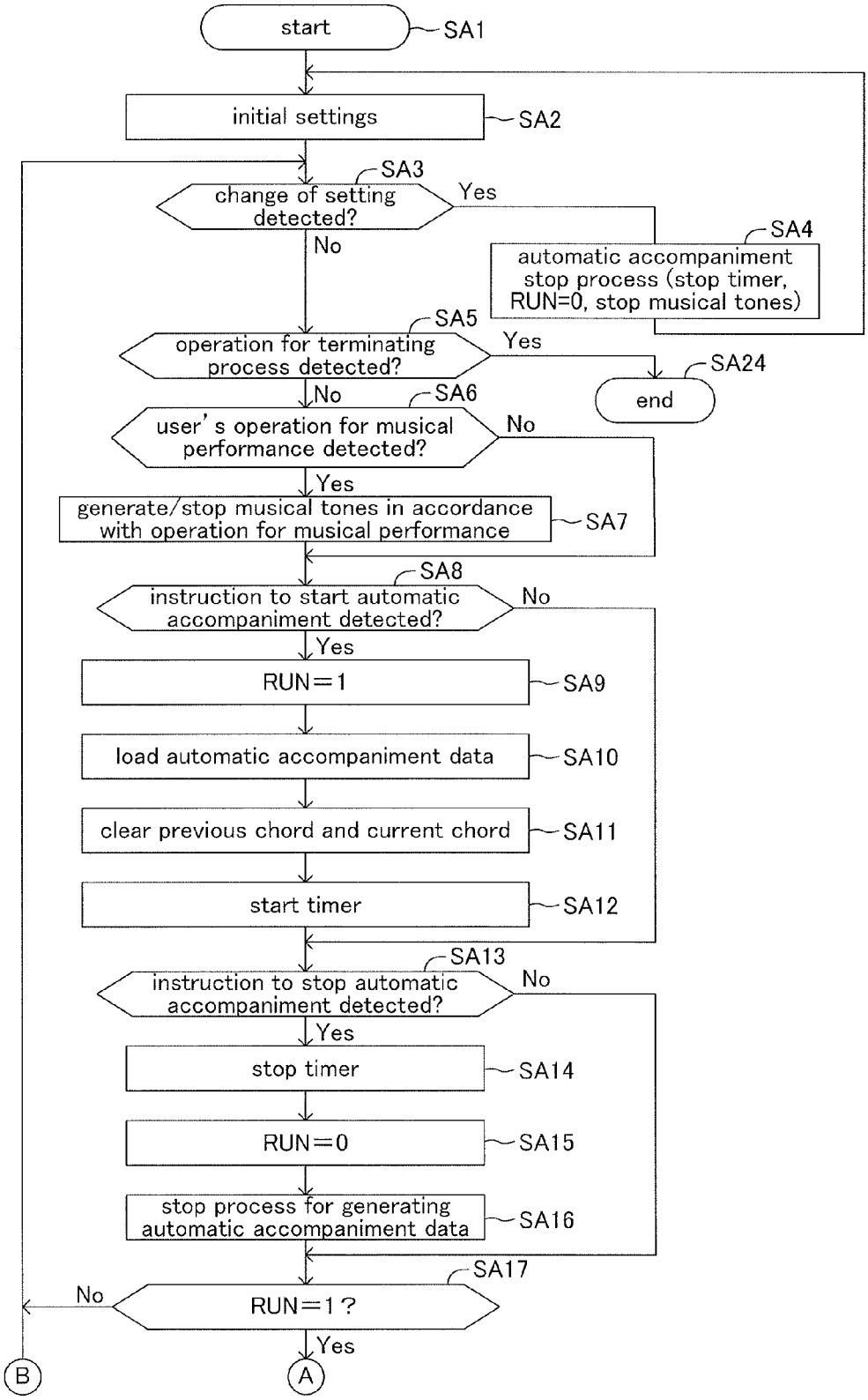
FIG. 5A is a flowchart of a part of a main process according to the first embodiment of the present invention.
Figure 5B:
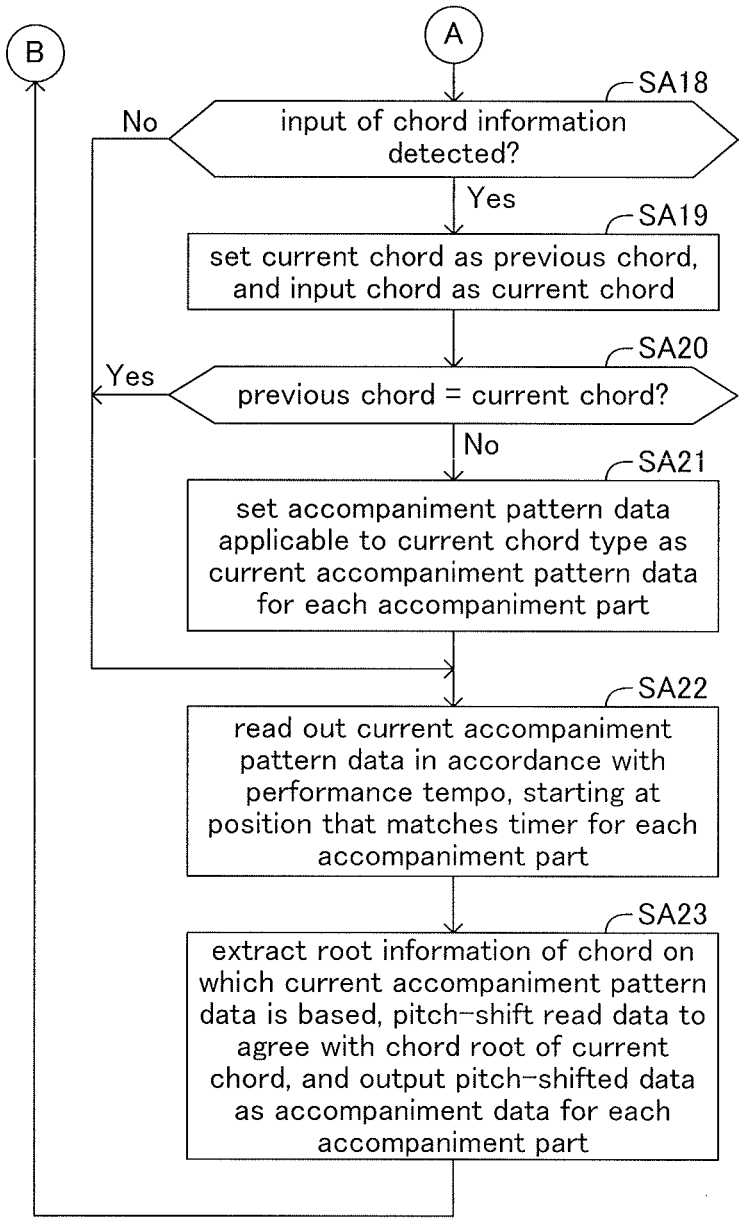
FIG. 5B is a flowchart of the other part of the main process according to the first embodiment of the present invention.

FIG. 5A and FIG. 5B are a flowchart of a main process of the first embodiment of the present invention. This main process starts when power of the accompaniment data generating apparatus 100 according to the first embodiment of the present invention is turned on.

At step SA1, the main process starts. At step SA2, initial settings are made. The initial settings include selection of automatic accompaniment data AA, designation of method of retrieving chord (input by user's musical performance, input by user's direct designation, automatic input based on chord progression information or the like), designation of performance tempo, and designation of key. The initial settings are made by use of the setting operating elements 12, for example, shown in FIG. 1. Furthermore, an automatic accompaniment process start flag RUN is initialized (RUN=0), and a timer, the other flags and registers are also initialized.

At step SA3, it is determined whether user's operation for changing a setting has been detected or not. The operation for changing a setting indicates a change in a setting which requires initialization of current settings such as re-selection of automatic accompaniment data AA. Therefore, the operation for changing a setting does not include a change in performance tempo, for example. When the operation for changing a setting has been detected, the process proceeds to step SA4 indicated by a "YES" arrow. When any operation for changing a setting has not been detected, the process proceeds to step SA5 indicated by a "NO" arrow.

At step SA4, an automatic accompaniment stop process is performed. The automatic accompaniment stop process stops the timer and sets the flag RUN at 0 (RUN=0), for example, to perform the process for stopping musical tones currently generated by automatic accompaniment. Then, the process returns to SA2 to make initial settings again in accordance with the detected operation for changing the setting. In a case where any automatic accompaniment is not being performed, the process directly returns to step SA2.

At step SA5, it is determined whether or not operation for terminating the main process (the power-down of the accompaniment data generating apparatus 100) has been detected. When the operation for terminating the process has been detected, the process proceeds to step SA24 indicated by a "YES" arrow to terminate the main process. When the operation for terminating the process has not been detected, the process proceeds to step SA6 indicated by a "NO" arrow.

At step SA6, it is determined whether or not user's operation for musical performance has been detected. The detection of user's operation for musical performance is done by detecting whether any musical performance signals have been input by operation of the performance operating elements 22 shown in FIG. 1 or any musical performance signals have been input via the communication I/F 21. In a case where operation for musical performance has been detected, the process proceeds to step SA7 indicated by a "YES" arrow to perform a process for generating musical tones or a process for stopping musical tones in accordance with the detected operation for musical performance to proceed to step SA8. In a case where any musical performance operations have not been detected, the process proceeds to step SA8 indicated by a "NO" arrow.

At step SA8, it is determined whether or not an instruction to start automatic accompaniment has been detected. The instruction to start automatic accompaniment is made by user's operation of the setting operating element 12, for example, shown in FIG. 1. In a case where the instruction to start automatic accompaniment has been detected, the process proceeds to step SA9 indicated by a "YES" arrow. In a case where the instruction to start automatic accompaniment has not been detected, the process proceeds to step SA13 indicated by a "NO" arrow.

At step SA9, the flag RUN is set at 1 (RUN=1). At step SA10, automatic accompaniment data AA selected at step SA2 or step SA3 is loaded from the storage device 15 or the like shown in FIG. 1 to an area of the RAM 7, for example. Then, at step SA11, the previous chord and the current chord are cleared. At step SA12, the timer is started to proceed to step SA13.

At step SA13, it is determined whether or not an instruction to stop the automatic accompaniment has been detected. The instruction to stop automatic accompaniment is made by user's operation of the setting operating elements 12 shown in FIG. 1, for example. In a case where an instruction to stop the automatic accompaniment has been detected, the process proceeds to step SA14 indicated by a "YES" arrow. In a case where an instruction to stop the automatic accompaniment has not been detected, the process proceeds to step SA17 indicated by a "NO" arrow.

At step SA14, the timer is stopped. At step SA15, the flag RUN is set at 0 (RUN=0). At step SA16, the process for generating automatic accompaniment data is stopped to proceed to step SA17.

At step SA17, it is determined whether the flag RUN is set at 1. In a case where the RUN is 1 (RUN=1), the process proceeds to step SA18 of FIG. 5B indicated by a "YES" arrow. In a case where the RUN is 0 (RUN=0), the process returns to step SA3 indicated by a "NO" arrow.

At step SA18, it is determined whether input of chord information has been detected (whether chord information has been retrieved). In a case where input of chord information has been detected, the process proceeds to step SA19 indicated by a "YES" arrow. In a case where input of chord information has not been detected, the process proceeds to step SA22 indicated by a "NO" arrow.

The cases where input of chord information has not been detected include a case where automatic accompaniment is currently being generated on the basis of any chord information and a case where there is no valid chord information. In the case where there is no valid chord information, accompaniment data having only a rhythm part, for example, which does not require any chord information may be generated. Alternatively, step SA18 may be repeated to wait for generating of accompaniment data without proceeding to step SA22 until valid chord information is input.

The input of chord information is done by user's musical performance using the musical performance operating elements 22 or the like indicated in FIG. 1. The retrieval of chord information based on user's musical performance may be detected from a combined key-depressions made in a chord key range which is a range included in the musical performance operating elements 22 of the keyboard or the like, for example (in this case, any musical tones will not be emitted in response to the key-depressions). Alternatively, the detection of chord information may be done on the basis of depressions of keys detected on the entire keyboard within a predetermined timing period. Furthermore, known chord detection arts may be employed.

It is preferable that input chord information includes chord type information for identifying chord type and chord root information for identifying chord root. However, the chord type information and the chord root information for identifying chord type and chord root, respectively, may be obtained in accordance with a combination of tone pitches of musical performance signals input by user's musical performance or the like.

Furthermore, the input of chord information may not be limited to the musical performance operating elements 22 but may be done by the setting operating elements 12. In this case, chord information can be input as a combination of information (letter or numeric) indicative of a chord root and information (letter or numeric) indicative of a chord type. Alternatively, information indicative of an applicable chord may be input by use of a symbol or number (see a table indicated in FIG. 3, for example).

Furthermore, chord information may not be input by a user, but may be obtained by reading out a previously stored chord sequence (chord progression information) at a predetermined tempo, or by detecting chords from currently reproduced song data or the like.

At step SA19, the chord information specified as "current chord" is set as "previous chord", whereas the chord information detected (obtained) at step SA18 is set as "current chord".

At step SA20, it is determined whether the chord information set as "current chord" is the same as the chord information set as "previous chord". In a case where the two pieces of chord information are the same, the process proceeds to step SA22 indicated by a "YES" arrow. In a case where the two pieces of chord information are not the same, the process proceeds to step SA21 indicated by a "NO" arrow. At the first detection of chord information, the process proceeds to step SA21.

At step SA21, a set of accompaniment pattern data AP (phrase waveform data PW included in the accompaniment pattern data AP) that matches the chord type indicated by the chord information set as "current chord" is set as "current accompaniment pattern data" for each accompaniment part (track) included in the automatic accompaniment data AA loaded at step SA10.

At step SA22, for each accompaniment part (track) included in the automatic accompaniment data AA loaded at step SA10, the accompaniment pattern data AP (phrase waveform data PW included in the accompaniment pattern data AP) set at step SA21 as "current accompaniment pattern data" is read out in accordance with user's performance tempo, starting at the position that matches the timer.

At step SA23, for each accompaniment part (track) included in the automatic accompaniment data AA loaded at step SA10, chord root information of a chord on which the accompaniment pattern data AP (phrase waveform data PW of the accompaniment pattern data AP) set at SA21 as "current accompaniment pattern data" is based is extracted to calculate the difference in tone pitch between the chord root of the chord information set as the "current chord" to pitch-shift the data read at step SA22 on the basis of the calculated value to agree with the chord root of the chord information set as the "current chord" to output the pitch-shifted data as "accompaniment data". The pitch shifting is done by a known art. In a case where the calculated difference in tone pitch is 0, the read data is output as "accompaniment data" without pitch-shifting. Then, the process returns to step SA3 to repeat the following steps.

In a case where phrase waveform data PW is provided for every chord root (12 notes) as indicated in FIG. 4, a set of accompaniment pattern data (phrase waveform data PA included in the accompaniment pattern data) that matches the chord type and the chord root indicated by the chord information set at step SA21 as the "current chord" is set as "current accompaniment pattern data" to omit the pitch-shifting of step SA23. In a case where sets of phrase waveform data PW corresponding to two or more but not all of the chord roots (12 notes) are provided for each chord type, it is preferable to read out a set of phrase waveform data PW having a chord type indicated by the chord information set as the "current chord" and corresponding to a chord root having the smallest difference in tone pitch between the chord information to pitch-shift the read phrase waveform data PW by the difference. In this case, more specifically, it is preferable that the step SA21 will select a set of phrase waveform data PW corresponding to the chord root of the smallest difference in tone pitch between the chord information (chord root) set as the "current chord".

Furthermore, this embodiment is designed such that the automatic accompaniment data AA is selected by a user at step SA2 before the start of automatic accompaniment or at steps SA3, SA4 and SA2 during automatic accompaniment. In a case where previously stored chord sequence data or the like is reproduced, however, the chord sequence data or the like may include information for designating automatic accompaniment data AA to read out the information to automatically select automatic accompaniment data AA. Alternatively, automatic accompaniment data AA may be previously selected as default.

In the above-described first embodiment, furthermore, the instruction to start or stop reproduction of selected automatic accompaniment data AA is done by detecting user's operation at step SA8 or step SA13. However, the start and stop of reproduction of selected automatic accompaniment data AA may be automatically done by detecting start and stop of user's musical performance using the performance operating elements 22.

Furthermore, the automatic accompaniment may be immediately stopped in response to the detection of the instruction to stop automatic accompaniment at step SA13. However, the automatic accompaniment may be continued until the end or a break (a point at which notes are discontinued) of the currently reproduced phrase waveform data PW, and then be stopped.

As described above, according to the first embodiment of the present invention, sets of phrase waveform data PW in which musical tone waveforms are stored for each chord type are provided to correspond to sets of accompaniment pattern data AP. Therefore, the first embodiment enables automatic accompaniment which suits input chords.

Furthermore, there are cases where a tension tone becomes an avoid note by simple pitch shifting. In the first embodiment, however, a set of phrase waveform data PW in which a musical tone waveform has been recorded is provided for each chord type. Even if a chord including a tension tone is input, therefore, the first embodiment can manage the chord. Furthermore, the first embodiment can follow changes in chord type caused by chord changes.

Furthermore, because sets of phrase waveform data PW in which musical tone waveforms have been recorded are provided for chord types, the first embodiment can prevent deterioration of sound quality that could arise when accompaniment data is generated. In a case where phrase waveform data sets PW provided for respective chord types are provided for each chord root, furthermore, the first embodiment can also prevent deterioration of sound quality caused by pitch-shifting.

Furthermore, because accompaniment patterns are provided as phrase waveform data, the first embodiment enables automatic accompaniment of high sound quality. In addition, the first embodiment enables automatic accompaniment which uses peculiar musical instruments or peculiar scales for which a MIDI tone generator is difficult to generate musical tones.

b. Second Embodiment

Next, the second embodiment of the present invention will be explained. Because the accompaniment data generating apparatus of the second embodiment has the same hardware configuration as the hardware configuration of the accompaniment data generating apparatus 100 of the above-described first embodiment, the hardware configuration of the accompaniment data generating apparatus of the second embodiment will not be explained.

Figure 6A:
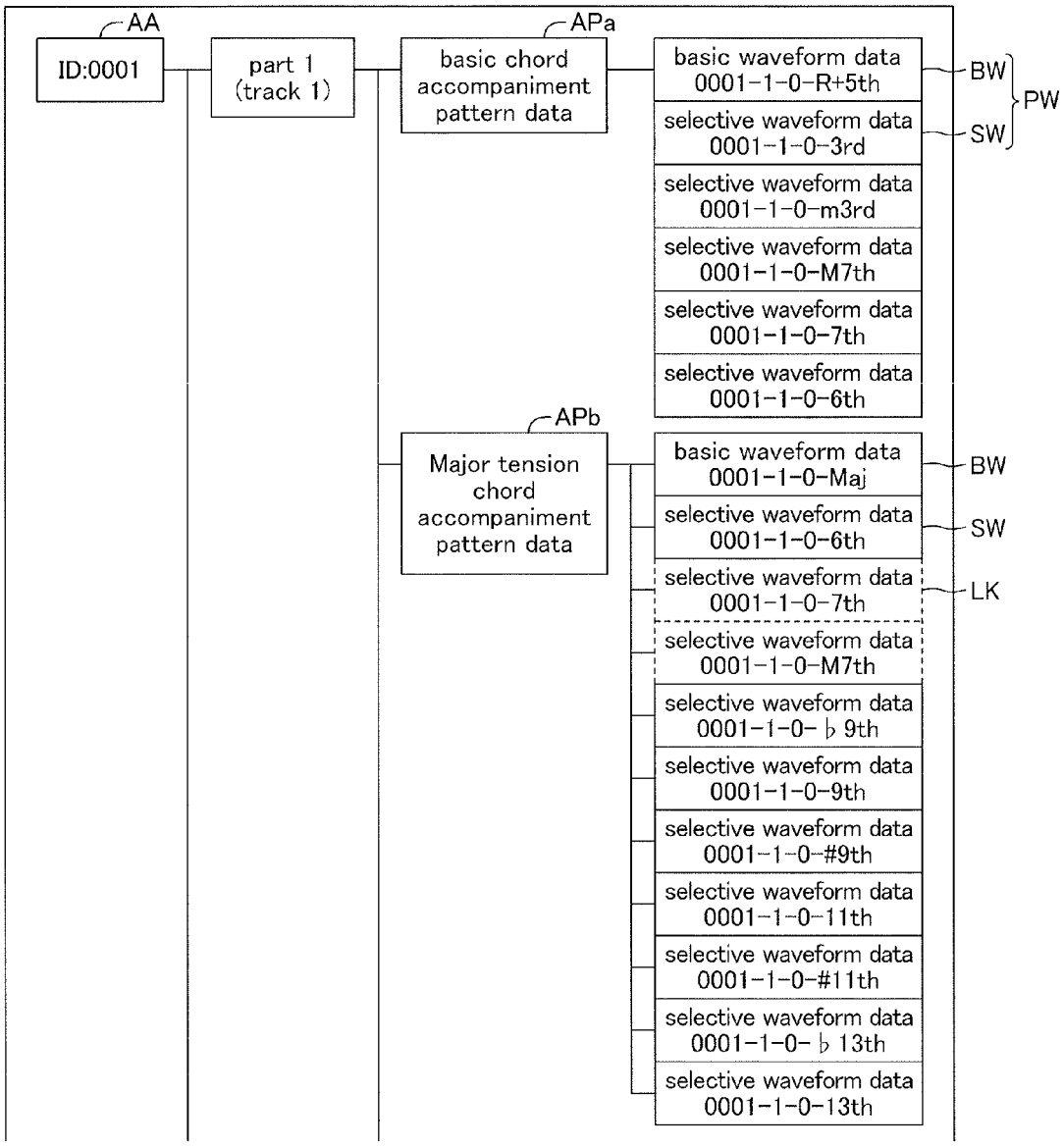
FIG. 6A is a part of a conceptual diagram indicative of an example configuration of automatic accompaniment data used in the second embodiment of the present invention.
Figure 6B:
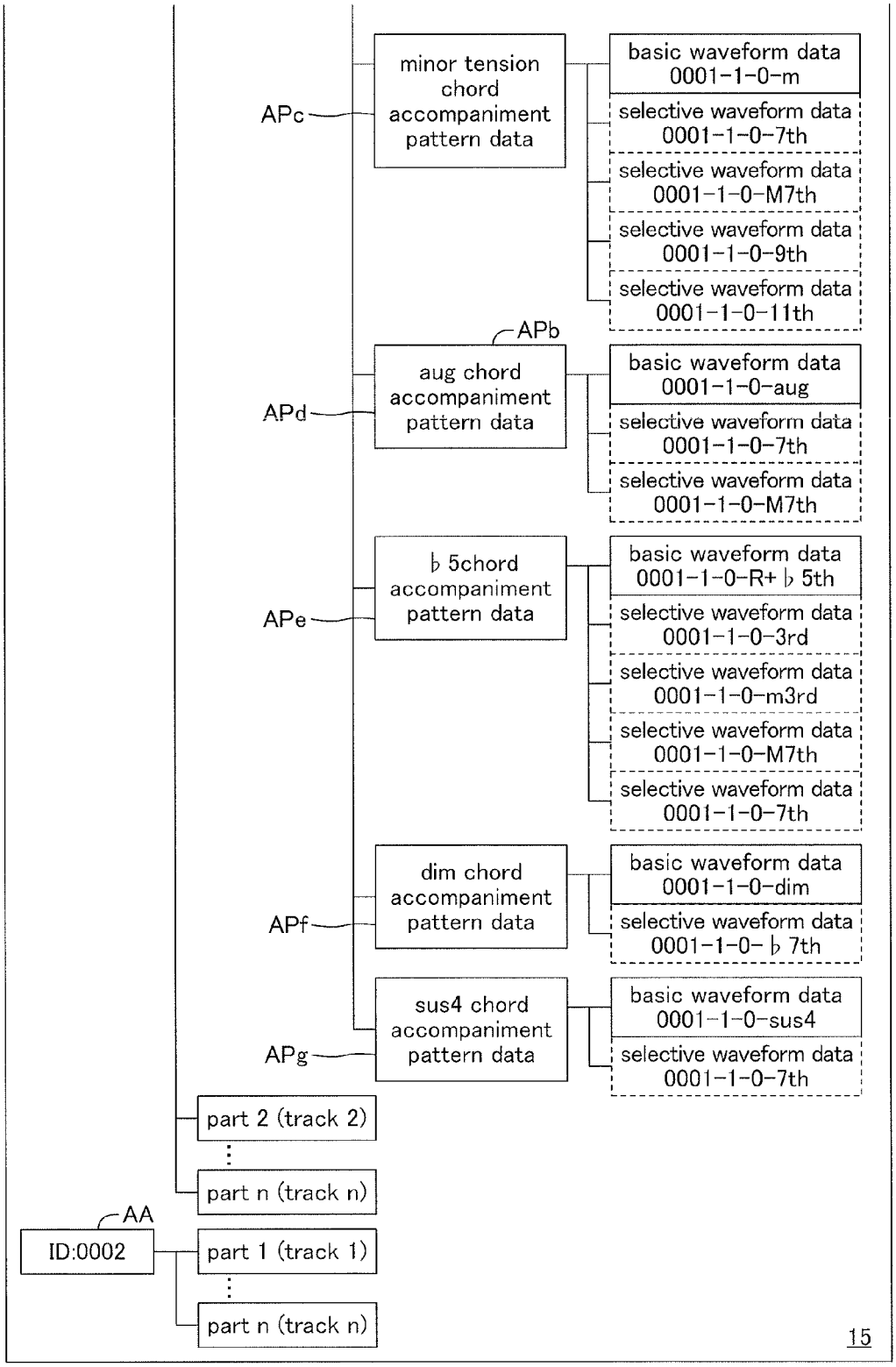
FIG. 6B is the other part of the conceptual diagram indicative of the example configuration of automatic accompaniment data used in the second embodiment of the present invention.

FIG. 6A and FIG. 6B are a conceptual diagram indicative of an example configuration of automatic accompaniment data AA according to the second embodiment of the present invention.

Each set of automatic accompaniment data AA includes one or more parts (tracks). Each accompaniment part includes at least one set of accompaniment pattern data AP (APa to APg). Each set of accompaniment pattern data AP includes one set of basic waveform data BW and one or more sets of selective waveform data SW. A set of automatic accompaniment data AA includes not only substantial data such as accompaniment pattern data AP but also setting information which is related to the entire automatic accompaniment data set and includes an accompaniment style name of the automatic accompaniment data set, time information, tempo information (tempo at which phrase waveform data PW is recorded (reproduced)) and information about the corresponding accompaniment part. In a case where a set of automatic accompaniment data AA is formed of a plurality of sections, furthermore, the automatic accompaniment data set AA includes the names and the number of measures (e.g., 1 measure, 4 measures, 8 measures, or the like) of the sections (intro, main, ending, and the like).

In the second embodiment, a set of basic waveform data BW and 0 or more sets of selective waveform data SW are combined in accordance with the chord type indicated by chord information input by user's operation for musical performance to pitch-shift the combined data in accordance with the chord root indicated by the input chord information to generate phrase waveform data (combined waveform data) corresponding to an accompaniment phrase based on the chord type and the chord root indicated by the input chord information.

The automatic accompaniment data AA according to the second embodiment of the invention is also the data for performing, when the user plays a melody line with the musical performance operating elements 22 indicated in FIG. 1, for example, automatic accompaniment of at least one accompaniment part (track) in accordance with the melody line.

In this case as well, sets of automatic accompaniment data AA are provided for each of various music genres such as jazz, rock and classic. The sets of automatic accompaniment data AA can be identified by identification number (ID number), accompaniment style name or the like. In the second embodiment, sets of automatic accompaniment data AA are stored in the storage device 15 or the ROM 8 indicated in FIG. 1, for example, with each automatic accompaniment data set AA being given an ID number (e.g., "0001", "0002" or the like).

The automatic accompaniment data AA is generally provided for each accompaniment style classified according to rhythm type, musical genre, tempo and the like. Furthermore, each automatic accompaniment data set AA contains a plurality of sections provided for a song such as intro, main, fill-in and ending. Furthermore, each section is configured by a plurality of tracks such as chord track, base track and drum (rhythm) track. For convenience in explanation, however, it is assumed in the second embodiment as well that the automatic accompaniment data set AA is configured by a section having a plurality of parts (accompaniment part 1 (track 1) to accompaniment part n (track n)) including at least a chord track for accompaniment which uses chords.

Each accompaniment pattern data set APa to APg (hereafter, accompaniment pattern data AP indicates any one or each of the accompaniment pattern data sets APa to APg) is applicable to one or more chord types, and includes a set of basic waveform data BW and one or more sets of selective waveform data SW which are constituent notes of the chord type (types). In the present invention, the basic waveform data BW is considered as basic phrase waveform data, while the selective waveform data SW is considered as selective phrase waveform data. Hereafter, in a case where either or both of the basic waveform data BW and the selective waveform data SW are indicated, the data is referred to as phrase waveform data PW. The accompaniment pattern data AP has not only phrase waveform data which is substantial data but also attribute information such as reference tone pitch information (chord root information) of the accompaniment pattern data AP, recording tempo (in a case where a common recording tempo is provided for all the automatic accompaniment data sets AA, the recording tempo can be omitted), length (time or the number of measures), identifier (ID), name, usage (for basic chord, for tension chord or the like), and the number of included phrase waveform data sets.

The basic waveform data BW is phrase waveform data created by digitally sampling musical tones played as an accompaniment having a length of one or more measures mainly using all or some of the constituent notes of a chord type to which the accompaniment pattern data AP is applicable. Furthermore, there can be sets of basic waveform data BW each of which includes tone pitches (which are not the chord notes) other than the notes which form the chord.

The selective waveform data SW is phrase waveform data created by digitally sampling musical tones played as an accompaniment having a length of one or more measures in which only one of the constituent notes of the chord type with which the accompaniment pattern data AP is correlated is used.

The basic waveform data BW and the selective waveform data SW are created on the basis of the same reference tone pitch (chord root). In the second embodiment, the basic waveform data BW and the selective waveform data SW are created on the basis of a tone pitch "C". However, the reference tone pitch is not limited to the tone pitch "C".

Each set of phrase waveform data PW (basic waveform data BW and selective waveform data SW) has an identifier by which the phrase waveform data set PW can be identified. In the second embodiment, each set of phrase waveform data PW has an identifier having a form "ID (style number) of automatic accompaniment data AA-accompaniment part (track) number-number indicative of a chord root (chord root information)-constituent note information (information indicative of notes which form a chord included in the phrase waveform data)". By employing a manner other than the above-described manner in which identifiers are used, attribute information may be provided for each set of phrase waveform data PW.

Furthermore, the sets of phrase waveform data PW may be stored in the automatic accompaniment data AA. Alternatively, the sets of phrase waveform data PW may be stored separately from the automatic accompaniment data AA which stores only information LK indicative of links to the phrase waveform data sets PW.

Referring to FIG. 6A and FIG. 6B, an example of a set of automatic accompaniment data AA of the second embodiment will be concretely explained. The automatic accompaniment data AA of the second embodiment has a plurality of accompaniment parts (tracks) 1 to n, while each of the accompaniment parts (tracks) 1 to n has a plurality of accompaniment pattern data sets AP. For accompaniment part 1, for instance, sets of accompaniment pattern data APa to APg are provided.

A set of accompaniment pattern data APa is basic chord accompaniment pattern data, and supports a plurality of chord types (Maj, 6, M7, m, m6, m7, mM7, 7). In order to generate phrase waveform data (combined waveform data) corresponding to an accompaniment based on these chord types, more specifically, the accompaniment pattern data APa has a set of phrase waveform data for accompaniment including a chord root and a perfect fifth as a set of basic waveform data BW. For combined use with the basic waveform data BW, furthermore, the accompaniment pattern data APa also has sets of selected waveform data SW corresponding to the chord constituent notes (major third, minor third, major seventh, minor seventh, and minor sixth).

A set of accompaniment pattern data APb is major tension chord accompaniment pattern data, and supports a plurality of chord types (M7 (#11), add9, M7 (9), 6 (9), 7 (9), 7 (#11), 7 (13), 7 (b9), 7 (b13), and 7 (#9)). In order to generate phrase waveform data (combined waveform data) corresponding to an accompaniment based on these chord types, more specifically, the accompaniment pattern data APb has a set of phrase waveform data for accompaniment including a chord root and tone pitches of a major third interval and a perfect fifth as a set of basic waveform data BW. For combined use with the basic waveform data BW, furthermore, the accompaniment pattern data APb also has sets of selective waveform data SW corresponding to chord constituent notes (major sixth, minor seventh, major seventh, major ninth, minor ninth, augmented ninth, perfect eleventh, augmented eleventh, minor thirteenth and major thirteenth).

A set of accompaniment pattern data APc is minor tension chord accompaniment pattern data, and supports a plurality of chord types (madd9, m7 (9), m7 (11) and mM7 (9)). In order to generate phrase waveform data (combined waveform data) corresponding to an accompaniment based on these chord types, more specifically, the accompaniment pattern data APc has a set of phrase waveform data for accompaniment including a chord root and tone pitches of a minor third and a perfect fifth as a set of basic waveform data BW. For combined use with the basic waveform data BW, furthermore, the accompaniment pattern data APc also has sets of selective waveform data SW corresponding to chord constituent notes (minor seventh, major seventh, major ninth, and perfect eleventh).

A set of accompaniment pattern data APd is augmented chord (aug) accompaniment pattern data, and supports a plurality of chord types (aug, 7 aug, M7 aug). In order to generate phrase waveform data (combined waveform data) corresponding to an accompaniment based on these chord types, more specifically, the accompaniment pattern data APd has a set of phrase waveform data for accompaniment including a chord root and tone pitches of a major third and an augmented fifth as a set of basic waveform data BW. For combined use with the basic waveform data BW, furthermore, the accompaniment pattern data APd also has sets of selective waveform data SW corresponding to chord constituent notes (minor seventh, and major seventh).

A set of accompaniment pattern data APe is flat fifth chord (b5) accompaniment pattern data, and supports a plurality of chord types (M7 (b5), b5, m7 (b5), m M7 (b5), 7 (b5)). In order to generate phrase waveform data (combined waveform data) corresponding to an accompaniment based on these chord types, more specifically, the accompaniment pattern data APe has a set of phrase waveform data for accompaniment including a chord root and a tone pitch of a diminished fifth as a set of basic waveform data BW. For combined use with the basic waveform data BW, furthermore, the accompaniment pattern data APe also has sets of selective waveform data SW corresponding to chord constituent notes (major third, minor third, minor seventh and major seventh).

A set of accompaniment pattern data APf is diminished chord (dim) accompaniment pattern data, and supports a plurality of chord types (dim, dim7). In order to generate phrase waveform data (combined waveform data) corresponding to an accompaniment based on these chord types, more specifically, the accompaniment pattern data APf has a set of phrase waveform data for accompaniment including a chord root and tone pitches of a minor third and a diminished fifth as a set of basic waveform data BW. For combined use with the basic waveform data BW, furthermore, the accompaniment pattern data APf also has a set of selective waveform data SW corresponding to a chord constituent note (diminished seventh).

A set of accompaniment pattern data APg is suspended fourth chord (sus 4) accompaniment pattern data, and supports a plurality of chord types (sus4, 7sus4). In order to generate phrase waveform data (combined waveform data) corresponding to an accompaniment based on these chord types, more specifically, the accompaniment pattern data APf has a set of phrase waveform data for accompaniment including a chord root and tone pitches of a perfect fourth and a perfect fifth as a set of basic waveform data BW. For combined use with the basic waveform data BW, furthermore, the accompaniment pattern data APg also has a set of selective waveform data SW corresponding to a chord constituent note (minor seventh).

In a case where a set of phrase waveform data PW provided for a set of accompaniment pattern data AP is also included in a different set of accompaniment pattern data AP, the accompaniment pattern data set AP may store link information LK indicative of a link to the phrase waveform data PW included in the different set of accompaniment pattern data AP as indicated by dotted lines of FIG. 6A and FIG. 6B. Alternatively, the identical data may be provided for both sets of accompaniment pattern data AP. Furthermore, the data having the identical tone pitches may be recorded as a phrase which is different from a phrase of the different set of accompaniment data AP.

By use of the accompaniment pattern data APb, furthermore, combined waveform data based on a chord type of the accompaniment pattern data APa such as Maj, 6, M7, 7 may be generated. By use of the accompaniment pattern data APc, furthermore, combined waveform data based on a chord type of the accompaniment pattern data APa such as m, m6, m7, mM7 may be generated. In this case, data generated by use of the accompaniment pattern data APb or APc may be either identical with or different from data generated by use of the accompaniment pattern data APa. In other words, the sets of phrase waveform data PW having the same tone pitches may be either identical or different with each other.

Figure 7:
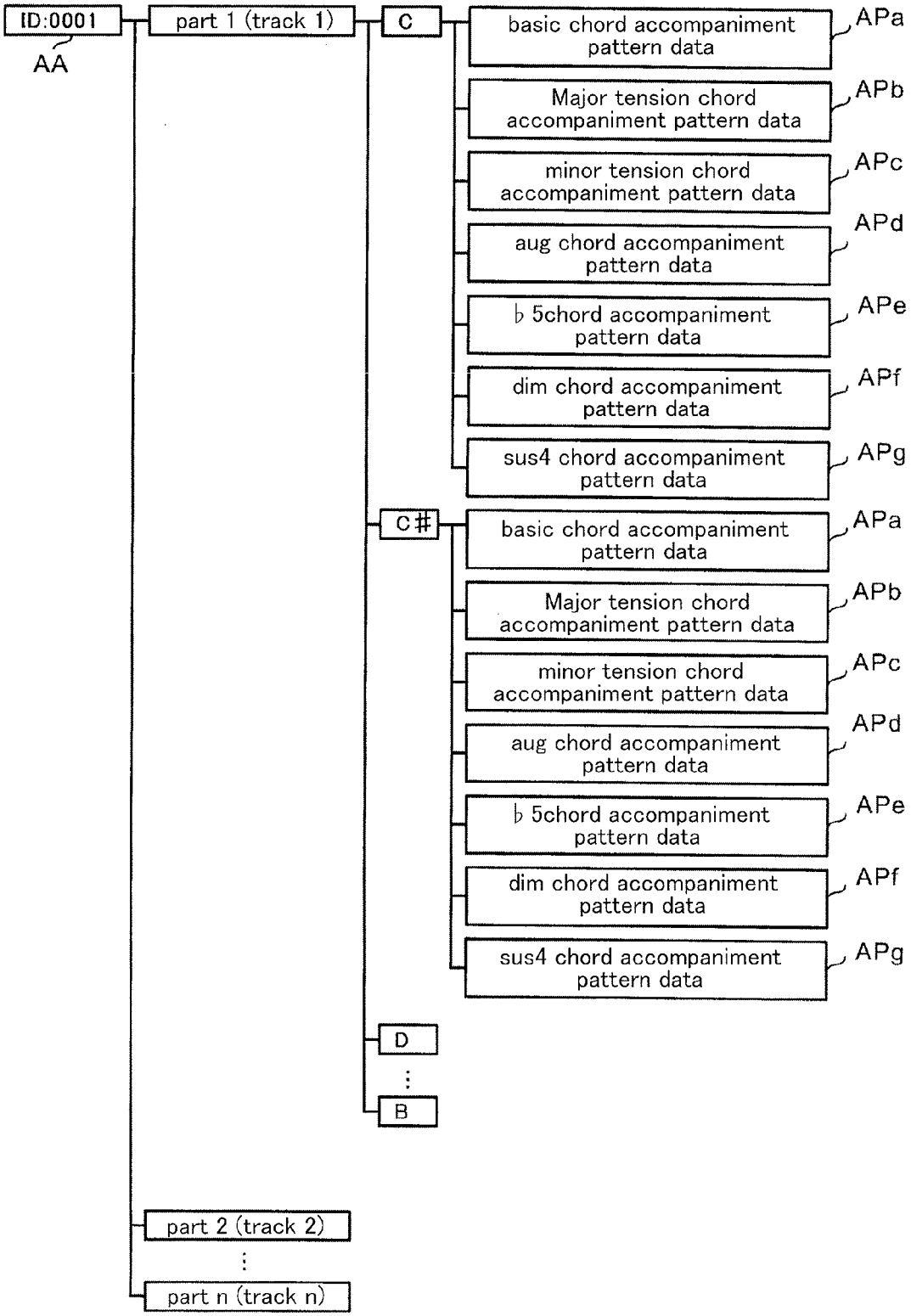
FIG. 7 is a conceptual diagram indicative of a different example configuration of automatic accompaniment data used in the second embodiment of the present invention.

In the example shown in FIG. 6A and FIG. 6B, each phrase waveform data PW has a chord root "C". However, the chord root may be any note. Furthermore, each chord type may have sets of phrase waveform data PW provided for a plurality (2 to 12) of chord roots. As indicated in FIG. 7, for example, in a case where a set of accompaniment pattern data AP is provided for every chord root (12 notes), the later-described pitch shifting is not necessary.

Figure 8A:
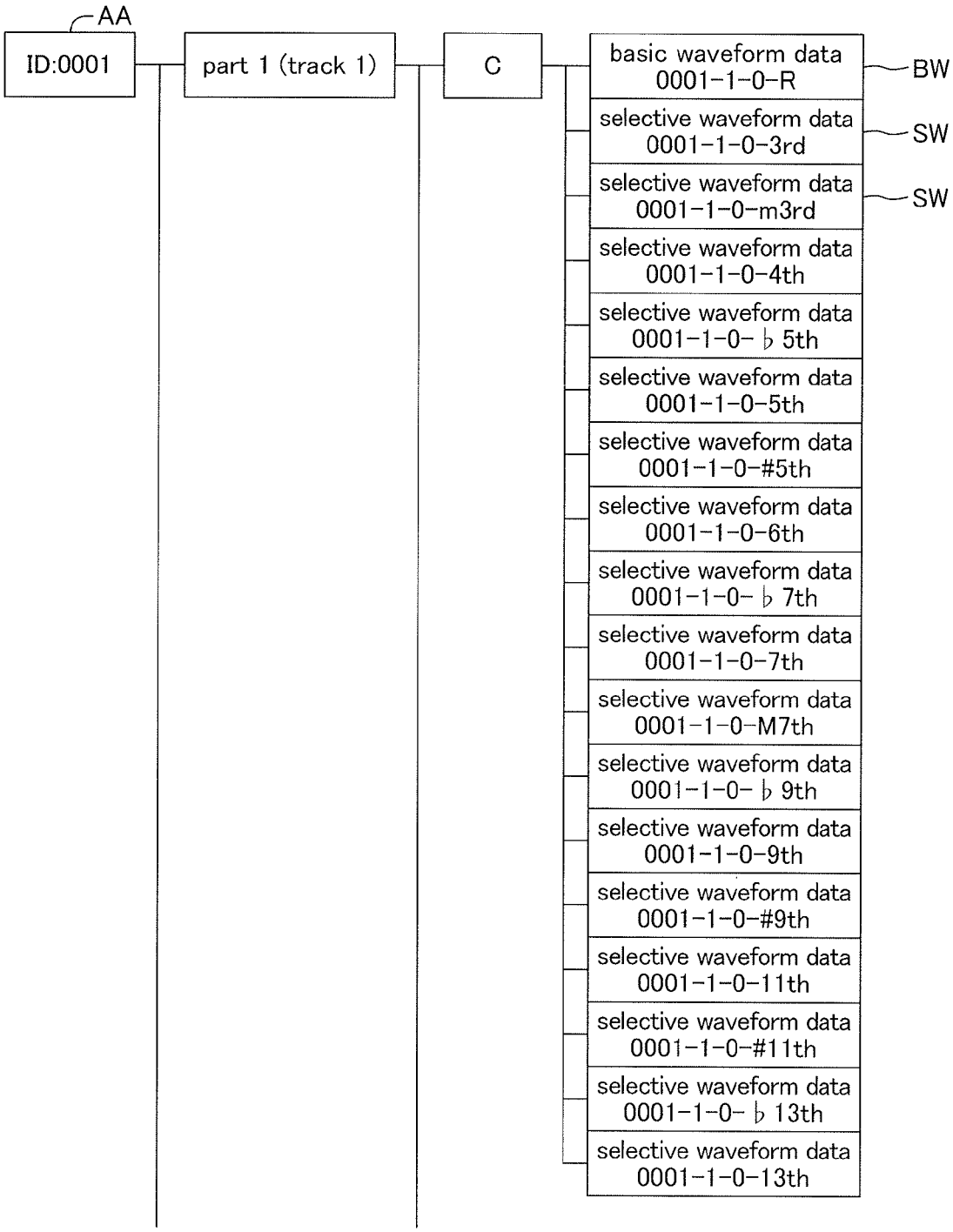
FIG. 8A is a part of the conceptual diagram indicative of the different example configuration of automatic accompaniment data used in the second embodiment of the present invention.
Figure 8B:
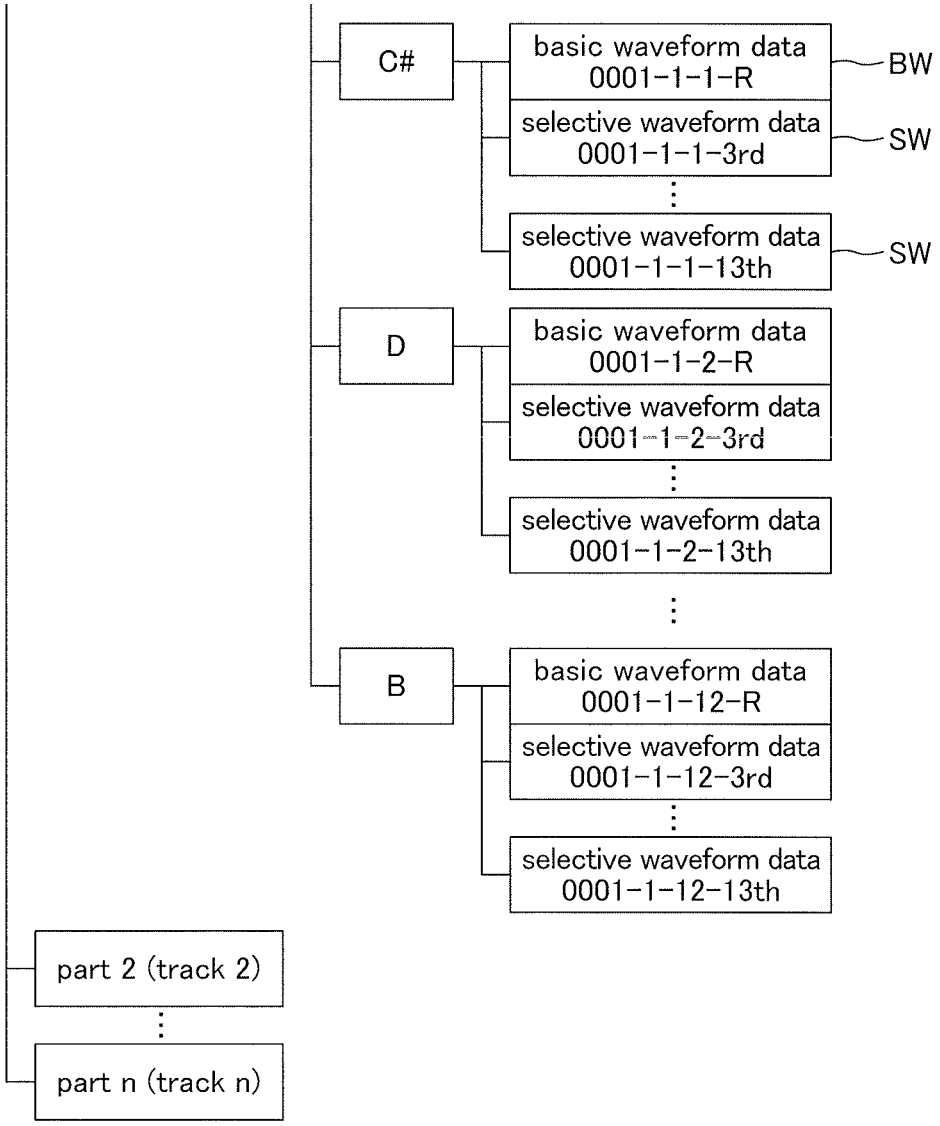
FIG. 8B is the other part of the conceptual diagram indicative of the different example configuration of automatic accompaniment data used in the second embodiment of the present invention.

As indicated in FIG. 8A and FIG. 8B, furthermore, the basic waveform data set BW may be correlated only with a chord root (and non-harmonic tones), while a set of selected waveform data SW may be provided for each constituent note other than the chord root. By this scheme, therefore, one set of accompaniment pattern data AP can support every chord type. As indicated in FIG. 8A and FIG. 8B, furthermore, by providing accompaniment pattern data AP for every chord root, the accompaniment pattern data AP can support every chord root without pitch shifting. Furthermore, accompaniment pattern data AP may support one or some of chord roots so that the other chord roots will be supported by pitch shifting. By providing selective waveform data SW for every constituent note, it is possible to generate combined waveform data by combining only constituent notes (chord root, third, seventh and the like, for example) which characterize a chord.

Figure 9A:
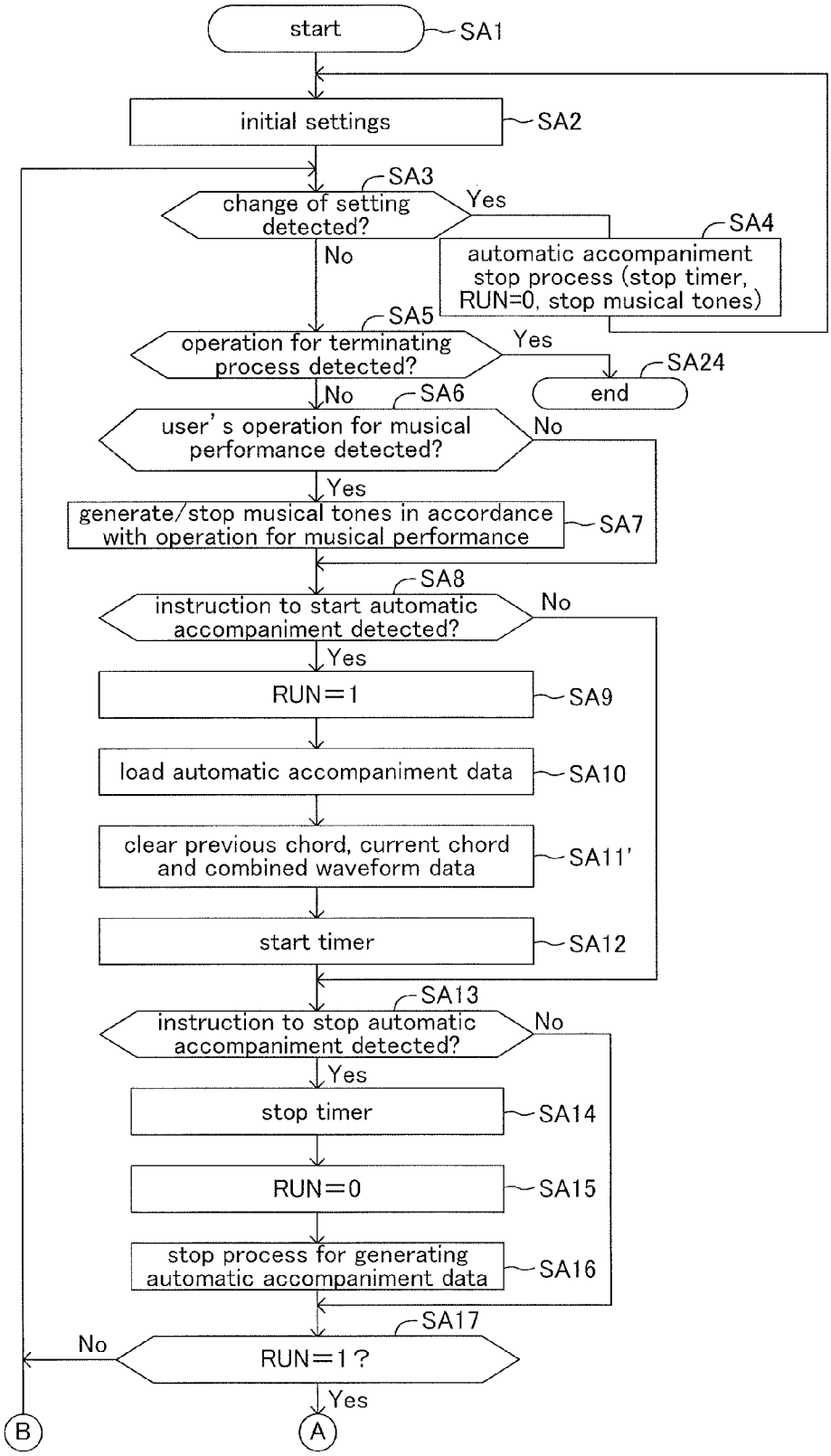
FIG. 9A a flowchart of a part of a main process according to the second and third embodiments of the present invention.
Figure 9B:
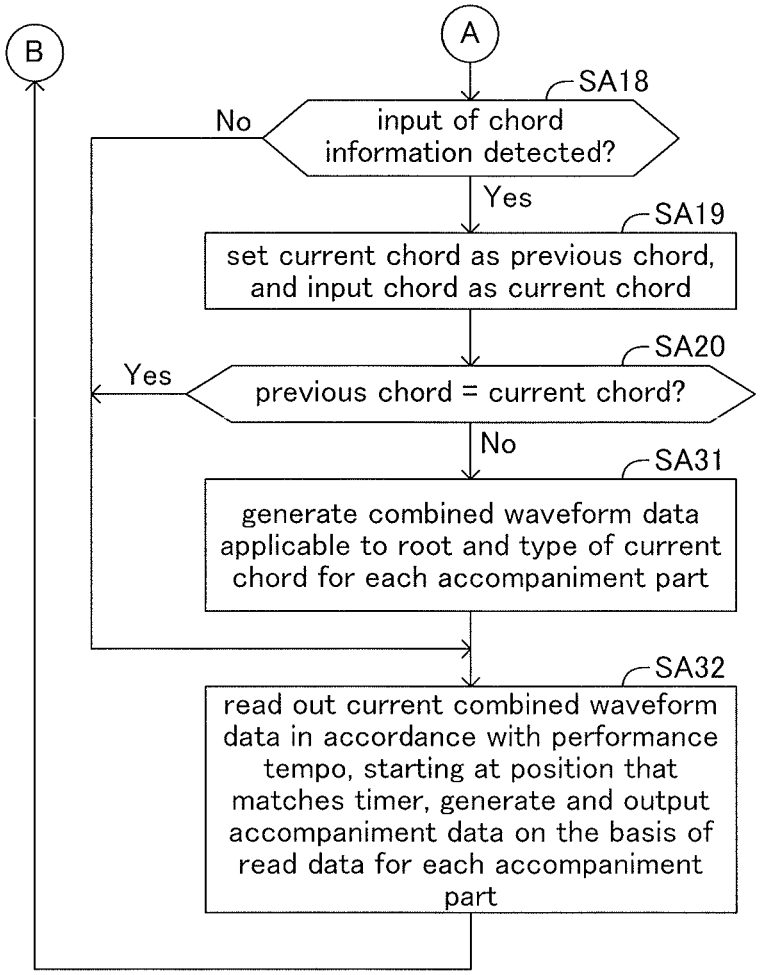
FIG. 9B is a flowchart of the other part of the main process according to the second and third embodiments of the present invention.

FIG. 9A and FIG. 9B are a flowchart indicative of a main process of the second embodiment of the present invention. In this embodiment as well, this main process starts when power of the accompaniment data generating apparatus 100 according to the second embodiment of the present invention is turned on. Steps SA1 to SA10 and steps SA12 to SA20 of the main process are similar to steps SA1 to SA10 and steps SA12 to SA20, respectively, of FIG. 5A and FIG. 5B of the above-described first embodiment. In the second embodiment, therefore, these steps are given the same numbers to omit explanation thereof. The modifications described as being applicable to steps SA1 to SA10 and steps SA12 to SA20 of the first embodiment can be also applicable to steps SA1 to SA10 and steps SA12 to SA20 of the second embodiment.

At step SA11' indicated in FIG. 9A, because combined waveform data is generated by later-described step SA31, the combined waveform data is also cleared in addition to the clearing of the previous chord and the current chord at step SA11 of the first embodiment. In a case where "NO" is given at step SA18 and in a case where "YES" is given at step SA20, the process proceeds to step SA32 indicated by arrows. In a case where "NO" is given at step SA20, the process proceeds to step SA31 indicated by a "NO" arrow.

At step SA31, combined waveform data applicable to the chord type and the chord root indicated by the chord information set as the "current chord" is generated for each accompaniment part (track) included in the automatic accompaniment data AA loaded at step SA10 to define the generated combined waveform data as the "current combined waveform data". The generation of combined waveform data will be described later with reference to FIG. 10.

At step SA32, the "current combined waveform data" defined at step SA31 is read out to start with data situated at a position which suits the timer in accordance with a specified performance tempo for each accompaniment part (track) of the automatic accompaniment data AA loaded at step SA10 so that accompaniment data will be generated to be output on the basis of the read data. Then, the process returns to step SA3 to repeat later steps.

Figure 10:
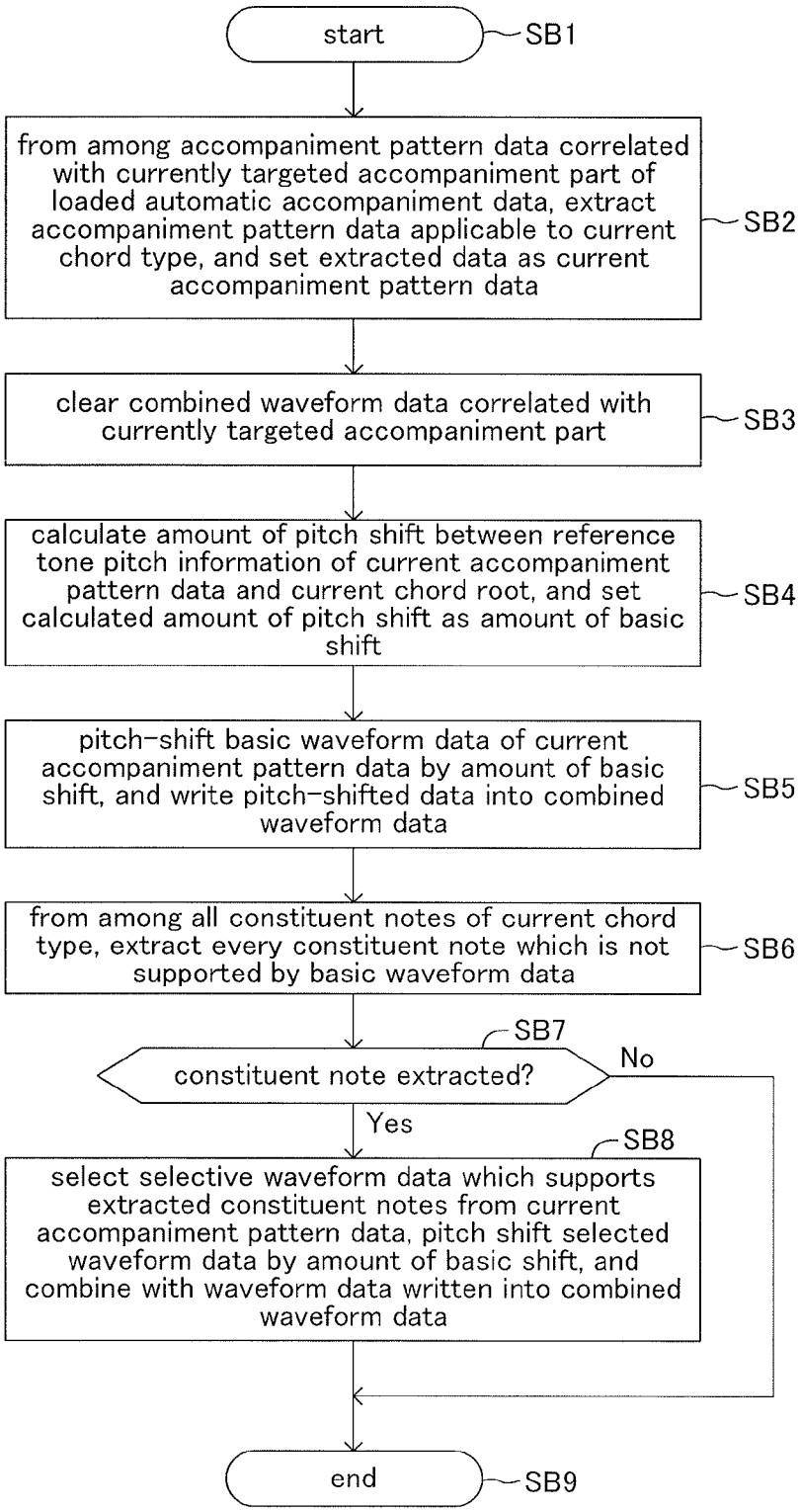
FIG. 10 is a flowchart of a combined waveform data generating process performed at step SA31 of FIG. 9B according to the second embodiment of the present invention.

FIG. 10 is a flowchart indicative of the combined waveform data generation process which will be executed at step SA31 of FIG. 9B. In a case where the automatic accompaniment data AA includes a plurality of accompaniment parts, the process will be repeated for the number of accompaniment parts. In this description, an example process for accompaniment part 1 of a case of the data structure indicated in FIG. 6A and FIG. 6B and having the input chord information of "Dm7" will be described.

At step SB1, the combined waveform data generation process starts. At step SB2, from among the accompaniment pattern data AP correlated with the currently targeted accompaniment part of the automatic accompaniment data AA loaded at step SA10 of FIG. 9A, the accompaniment pattern data AP correlated with the chord type indicated by the chord information set as the "current chord" at step SA19 of FIG. 9B is extracted to set as the "current accompaniment pattern data". In this case, the basic chord accompaniment pattern data APa which supports "Dm7" is set as the "current accompaniment pattern data".

At step SB3, combined waveform data correlated with the currently targeted accompaniment part is cleared.

At step SB4, an amount of pitch shift is figured out in accordance with a difference (a difference in tone pitch represented by the number of semitones, the interval, or the like) between the reference tone pitch information (chord root information) of the accompaniment pattern data AP set as the "current accompaniment pattern data" and the chord root of the chord information set as the "current chord" to set the obtained amount of pitch shift as "amount of basic shift". There can be a case where the amount of basic shift is negative. The chord root of the basic chord accompaniment pattern data APa is "C", while the chord root of the chord information is "D". Therefore, the "amount of basic shift" is "2 (the number of semitones)".

At step SB5, the basic waveform data BW of the accompaniment pattern data AP set as the "current accompaniment pattern data" is pitch-shifted by the "amount of basic shift" obtained at step SB4 to write the pitch-shifted data into the "combined waveform data". In other words, the tone pitch of the chord root of the basic waveform data BW of the accompaniment pattern data AP set as the "current accompaniment pattern data" is made equal to the chord root of the chord information set as the "current chord". Therefore, the pitch (tone pitch) of the chord root of the basic chord accompaniment pattern data APa is raised by 2 semitones to pitch shift to "D".

At step SB6, from among all the constituent notes of the chord type indicated by the chord information set as the "current chord", constituent notes which are not supported by the basic waveform data BW of the accompaniment pattern data AP set as the "current accompaniment pattern data" (which are not included in the basic waveform data BW) are extracted. The constituent notes of "m7" which is the "current chord" are "a root, a minor third, a perfect fifth, and a minor seventh", while the basic waveform data BW of the basic chord accompaniment pattern data APa includes "the root and the perfect fifth". Therefore, the constituent tones of "the minor third" and "the minor seventh" are extracted at step SB6.

At step SB7, it is judged whether there are constituent notes which are not supported by the basic waveform data BW extracted at step SB6 (which are not included in the basic waveform data BW). In a case where there are extracted constituent notes, the process proceeds to step SB8 indicated by a "YES" arrow. In a case where there are no extracted notes, the process proceeds to step SB9 indicated by a "NO" arrow to terminate the combined waveform data generation process to proceed to step SA32 of FIG. 9B.

At step SB8, selective waveform data SW which supports the constituent notes extracted at step SB6 (which includes the constituent notes) is selected from the accompaniment pattern data AP set as the "current accompaniment pattern data" to pitch shift the selective waveform data SW by the "amount of basic shift" obtained at step SB4 to combine with the basic waveform data BW written into the "combined waveform data" to renew the "combined waveform data". Then, the process proceeds to step SB9 to terminate the combined waveform data generation process to proceed to step SA32 of FIG. 9B. At step SB8, more specifically, the selective waveform data sets SW including the "minor third" and the "minor seventh" are pitch-shifted by "2 semitones" to combine with the written "combined waveform data" obtained by pitch-shifting the basic waveform data BW of the basic chord accompaniment pattern data APa by "2 semitones" to be provided as combined waveform data for accompaniment based on "Dm7".

As indicated in FIG. 7, in a case where phrase waveform data PW is provided for every chord root (12 notes), the accompaniment pattern data (phrase waveform data PA included in the accompaniment pattern data) applicable to the chord type and chord root indicated by the chord information set as the "current chord" is set as the "current accompaniment data" at step SB2, while the pitch shifting at steps SB4, SB5 and SB8 will be omitted. In a case where phrase waveform data PW for two or more chord roots but not for every chord root (12 notes) is provided for each chord type, it is preferable to read out phrase waveform data PW of the chord root having the smallest difference in tone pitch between the chord information set as the "current chord" to define the difference in tone pitch as the "amount of basic shift". In this case, it is preferable to select phrase waveform data PW of the chord root having the smallest difference in tone pitch between the chord information (chord root) set as the "current chord" at step SB2.

In the above-described second embodiment and its modification, the basic waveform data BW and the selective waveform data SW are pitch-shifted by the "amount of basic shift" at step SB5 and step SB8. By steps SB5 and SB8, furthermore, the pitch-shifted basic waveform data BW and the pitch-shifted selective waveform data SW are combined. Instead of the steps, however, the combined waveform data may be eventually pitch-shifted by the "amount of basic shift" as follows. More specifically, the basic waveform data BW and the selective waveform data SW will not be pitch-shifted at steps SB5 and SB8, but the waveform data combined at steps SB5 and SB8 will be pitch-shifted by the "amount of basic shift" at step SB8.

According to the second embodiment of the present invention, as described above, by providing the basic waveform data BW and the selective waveform data SW correlated with the accompaniment pattern data AP and combining the data, combined waveform data applicable to a plurality of chord types can be generated to enable automatic accompaniment which suits input chords.

Furthermore, phrase waveform data including only one tension tone or the like can be provided as selective waveform data SW to combine the waveform data so that the second embodiment can manage chords having a tension tone. Furthermore, the second embodiment can follow changes in chord type brought about by chord change.

In a case where phrase waveform data PW is provided for every chord root, furthermore, the second embodiment can prevent deterioration of sound quality caused by pitch shifting.

Furthermore, because accompaniment patterns are provided as phrase waveform data, the second embodiment enables automatic accompaniment of high sound quality. In addition, the second embodiment enables automatic accompaniment which uses peculiar musical instruments or peculiar scales for which a MIDI tone generator is difficult to generate musical tones.

c. Third Embodiment

Next, the third embodiment of the present invention will be explained. Because the accompaniment data generating apparatus of the third embodiment has the same hardware configuration as the hardware configuration of the accompaniment data generating apparatus 100 of the above-described first and second embodiments, the hardware configuration of the accompaniment data generating apparatus of the third embodiment will not be explained.

Figure 11:
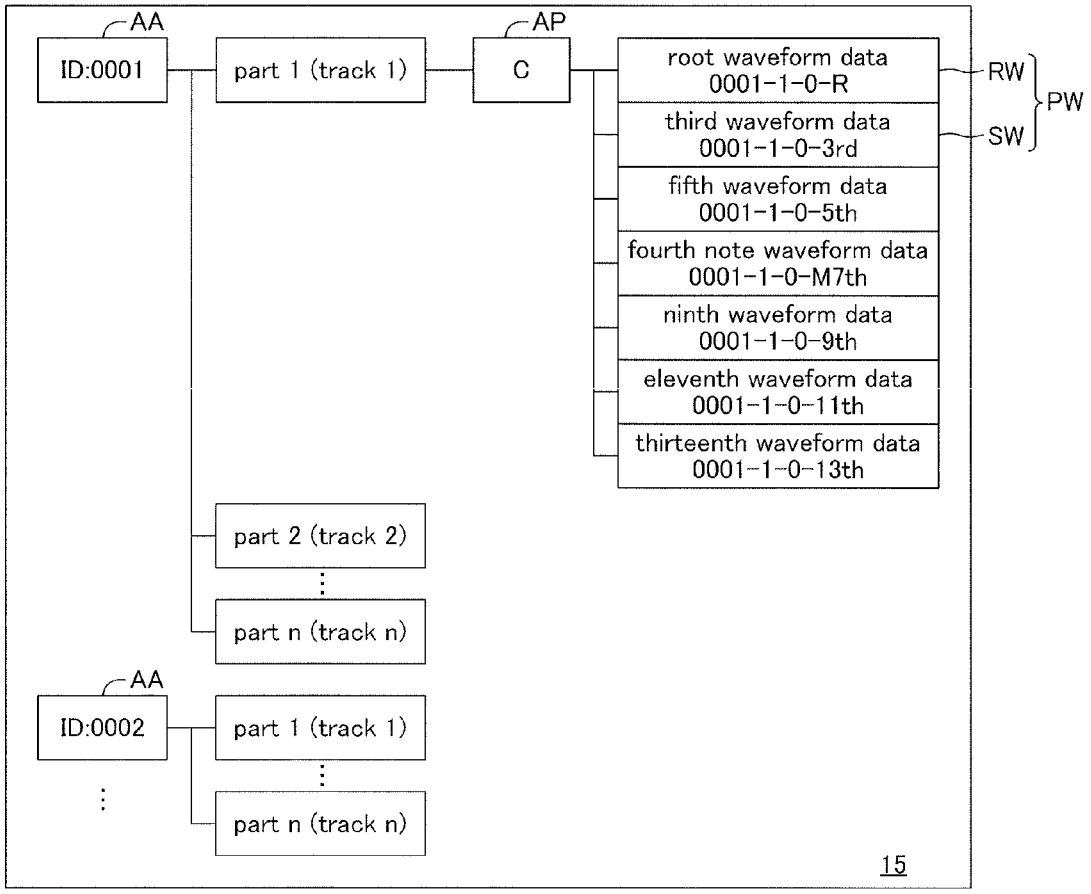
FIG. 11 is a conceptual diagram indicative of an example configuration of automatic accompaniment data used in the third embodiment of the present invention.

FIG. 11 is a conceptual diagram indicative of an example configuration of automatic accompaniment data AA according to the third embodiment of the present invention.

A set of automatic accompaniment data AA includes one or more parts (tracks). Each accompaniment part includes at least one set of accompaniment pattern data AP. Each set of accompaniment pattern data AP includes one set of root waveform data RW and sets of selective waveform data SW. A set of automatic accompaniment data AA includes not only substantial data such as accompaniment pattern data AP but also setting information which is related to the entire automatic accompaniment data set and includes an accompaniment style name of the automatic accompaniment data set, time information, tempo information (tempo at which phrase waveform data PW is recorded (reproduced)) and information about respective accompaniment parts. In a case where a set of automatic accompaniment data AA is formed of a plurality of sections, furthermore, the automatic accompaniment data set AA includes the names and the number of measures (e.g., 1 measure, 4 measures, 8 measures, or the like) of the sections (intro, main, ending, and the like).

The automatic accompaniment data AA according to the third embodiment of the invention is also the data for performing, when the user plays a melody line with the musical performance operating elements 22 indicated in FIG. 1, for example, automatic accompaniment of at least one accompaniment part (track) in accordance with the melody line.

In this case as well, sets of automatic accompaniment data AA are provided for each of various music genres such as jazz, rock and classic. The sets of automatic accompaniment data AA can be identified by identification number (ID number), accompaniment style name or the like. In the third embodiment, sets of automatic accompaniment data AA are stored in the storage device 15 or the ROM 8 indicated in FIG. 1, for example, with each automatic accompaniment data set AA being given an ID number (e.g., "0001", "0002" or the like).

The automatic accompaniment data AA is generally provided for each accompaniment style classified according to rhythm type, musical genre, tempo and the like. Furthermore, each automatic accompaniment data set AA contains a plurality of sections provided for a song such as intro, main, fill-in and ending. Furthermore, each section is configured by a plurality of tracks such as chord track, base track and drum (rhythm) track. For convenience in explanation, however, it is assumed in the third embodiment as well that the automatic accompaniment data set AA is configured by a section having a plurality of accompaniment parts (part 1 (track 1) to part n (track n)) including at least a chord track for accompaniment which uses chords.

Each accompaniment pattern data set AP is applicable to a plurality of chord types of a reference tone pitch (chord root), and includes a set of root waveform data RW and one or more sets of selective waveform data SW which are constituent notes of the chord types. In the present invention, the root waveform data RW is considered as basic phrase waveform data, while the sets of selective waveform data SW are considered as selective phrase waveform data. Hereafter, in a case where either or both of the basic waveform data BW and the selective waveform data SW are indicated, the data is referred to as phrase waveform data PW. The accompaniment pattern data AP has not only phrase waveform data PW which is substantial data but also attribute information such as reference tone pitch information (chord root information) of the accompaniment pattern data AP, recording tempo (in a case where a common recording tempo is provided for all the automatic accompaniment data sets AA, the recording tempo can be omitted), length (time or the number of measures), identifier (ID), name, and the number of included phrase waveform data sets.

The root waveform data RW is phrase waveform data created by digitally sampling musical tones played as an accompaniment having a length of one or more measures mainly using a chord root to which the accompaniment pattern data AP is applicable. In other words, the root waveform data RW is phrase waveform data which is based on the root. Furthermore, there can be sets of root waveform data BW each of which includes tone pitches (which are not the chord notes) other than the notes which form the chord.

The selective waveform data SW is phrase waveform data created by digitally sampling musical tones played as an accompaniment having a length of one or more measures in which only one of the constituent notes of a major third, perfect fifth and major seventh (fourth note) above the chord root to which the accompaniment pattern data AP is applicable is used. If necessary, furthermore, sets of selective waveform data SW using only major ninth, perfect eleventh and major thirteenth, respectively, which are constituent notes for tension chords may be provided.

The root waveform data RW and the selective waveform data SW are created on the basis of the same reference tone pitch (chord root). In the third embodiment, the root waveform data RW and the selective waveform data SW are created on the basis of a tone pitch "C". However, the reference tone pitch is not limited to the tone pitch "C".

Each set of phrase waveform data PW (root waveform data RW and selective waveform data SW) has an identifier by which the phrase waveform data set PW can be identified. In the third embodiment, each set of phrase waveform data PW has an identifier having a form "ID (style number) of automatic accompaniment data AA-accompaniment part (track) number-number indicative of a chord root (chord root information)-constituent note information (information indicative of notes which form a chord included in the phrase waveform data)". By employing a manner other than the above-described manner in which identifiers are used, attribute information may be provided for each set of phrase waveform data PW.

Furthermore, the sets of phrase waveform data PW may be stored in the automatic accompaniment data AA. Alternatively, the sets of phrase waveform data PW may be stored separately from the automatic accompaniment data AA which stores only information LK indicative of links to the phrase waveform data sets PW.

Figure 12:
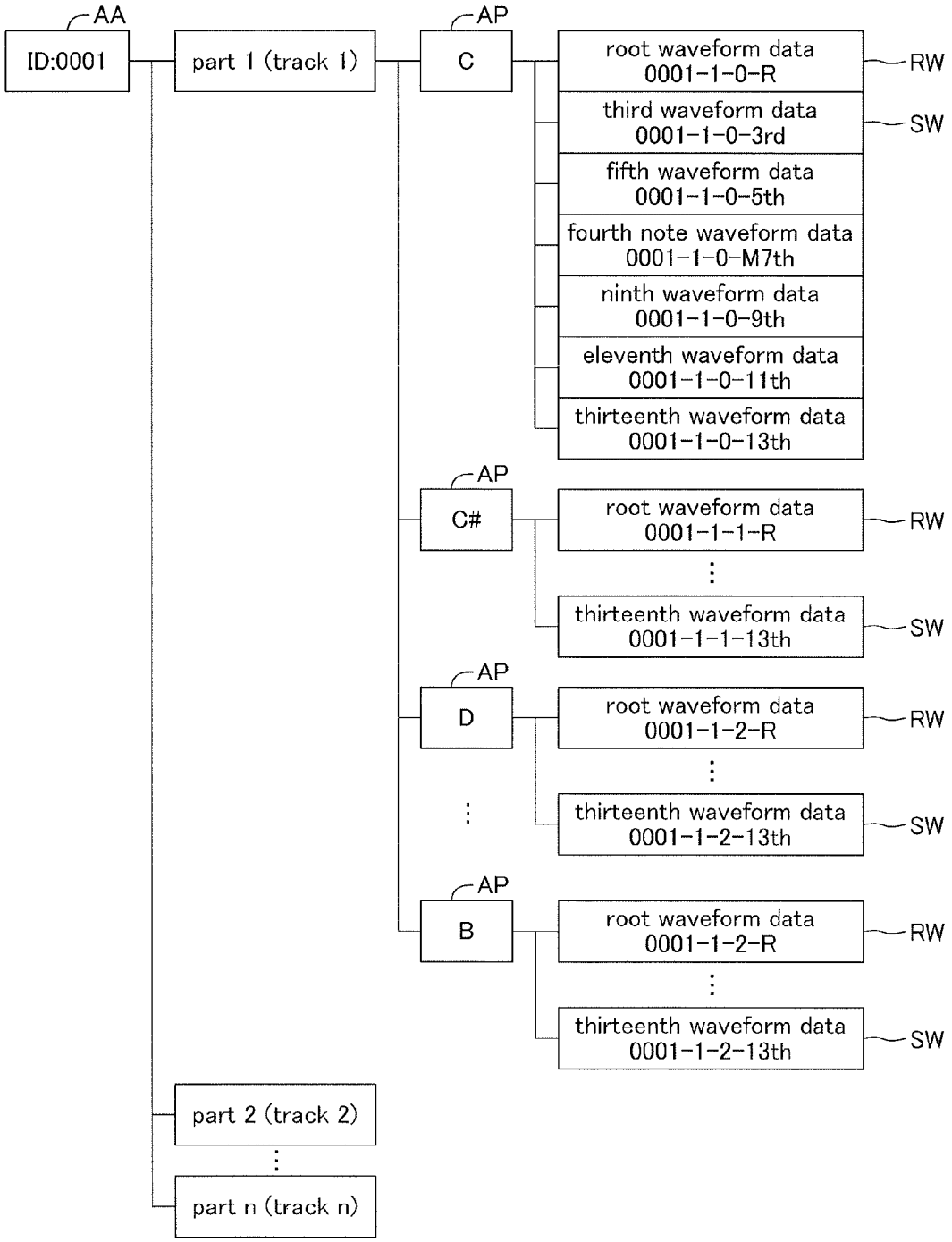
FIG. 12 is a conceptual diagram indicative of a different example configuration of automatic accompaniment data used in the third embodiment of the present invention.

In the example indicated in FIG. 11, each phrase waveform data PW has a root (root note) of "C". However, each phrase waveform data PW may have any chord root. Furthermore, sets of phrase waveform data PW of a plurality of chord roots (2 to 12 roots) may be provided for each chord type. As indicated in FIG. 12, for example, accompaniment pattern data AP may be provided for every chord root (12 notes).

In the example indicated in FIG. 11, furthermore, phrase waveform data sets for a major third (distance of 4 semitones), a perfect fifth (distance of 7 semitones), and a major seventh (distance of 11 semitones) are provided as selective waveform data SW. However, phrase waveform data sets for different intervals such as a minor third (distance of 3 semitones) and a minor seventh (distance of 10 semitones) may be provided.

FIG. 13 is a conceptual diagram indicative of an example table of distance of semitones organized by chord type according to the third embodiment of the present invention.

In the third embodiment, root waveform data RW is pitch-shifted according to the chord root of chord information input by user's musical performance or the like, while one or more sets of selective waveform data SW are also pitch-shifted according to the chord root and the chord type to combine the pitch-shifted root waveform data RW with the pitch-shifted one or more sets of selective waveform data SW to generate phrase waveform data (combined waveform data) suitable for accompaniment phrase based on the chord type and the chord root indicated by the input chord information.

In the third embodiment, selective waveform data SW is provided only for a major third (distance of 4 semitones), a perfect fifth (distance of 7 semitones) and a major seventh (distance of 11 semitones) (a major ninth, a perfect eleventh, a major thirteenth). For the other constituent notes, therefore, it is necessary to pitch-shift selective waveform data SW in accordance with the chord type. Therefore, when one or more sets of selective waveform data SW are pitch-shifted in accordance with the chord root and the chord type, the chord type-organized semitone distance table indicated in FIG. 13 is referred to.

The chord type-organized semitone distance table is a table which stores each distance indicated by semitones from chord root to chord root, a third, a fifth and the fourth note of a chord of each chord type. In a case of a major chord (Maj), for example, respective distances of semitones from a chord root to the chord root, a third and a fifth of the chord are 0, 4, and 7, respectively. In this case, pitch-shifting according to chord type is not necessary, for selective waveform data SW is provided for the major third (distance of 4 semitones) and the perfect fifth (distance of 7 semitones). However, the chord type-organized semitone distance table indicates that in a case of minor seventh (m7), because respective distances of semitones from a chord root to the chord root, a third, a fifth and the fourth note (e.g., seventh) are 0, 3, 7, and 10, respectively, it is necessary to lower respective pitches of selective waveform data sets SW for the major third (distance of 4 semitones) and the major seventh (distance of 11 semitones) by one semitone.

In a case where selective waveform data SW for tension chord tone is used, it is necessary to add respective distances of semitones from chord root to ninth, eleventh and thirteenth intervals to the chord type-organized semitone distance table.

In the third embodiment as well, the main process program starts when power of the accompaniment data generating apparatus 100 is turned on. Because the main process program of the third embodiment is the same as the main process program of FIG. 9A and FIG. 9B according to the second embodiment, the explanation of the main process program of the third embodiment will be omitted. However, the combined waveform data generation process executed at step SA31 will be done by a program indicated in FIG. 14A and FIG. 14B.

Figure 14A:
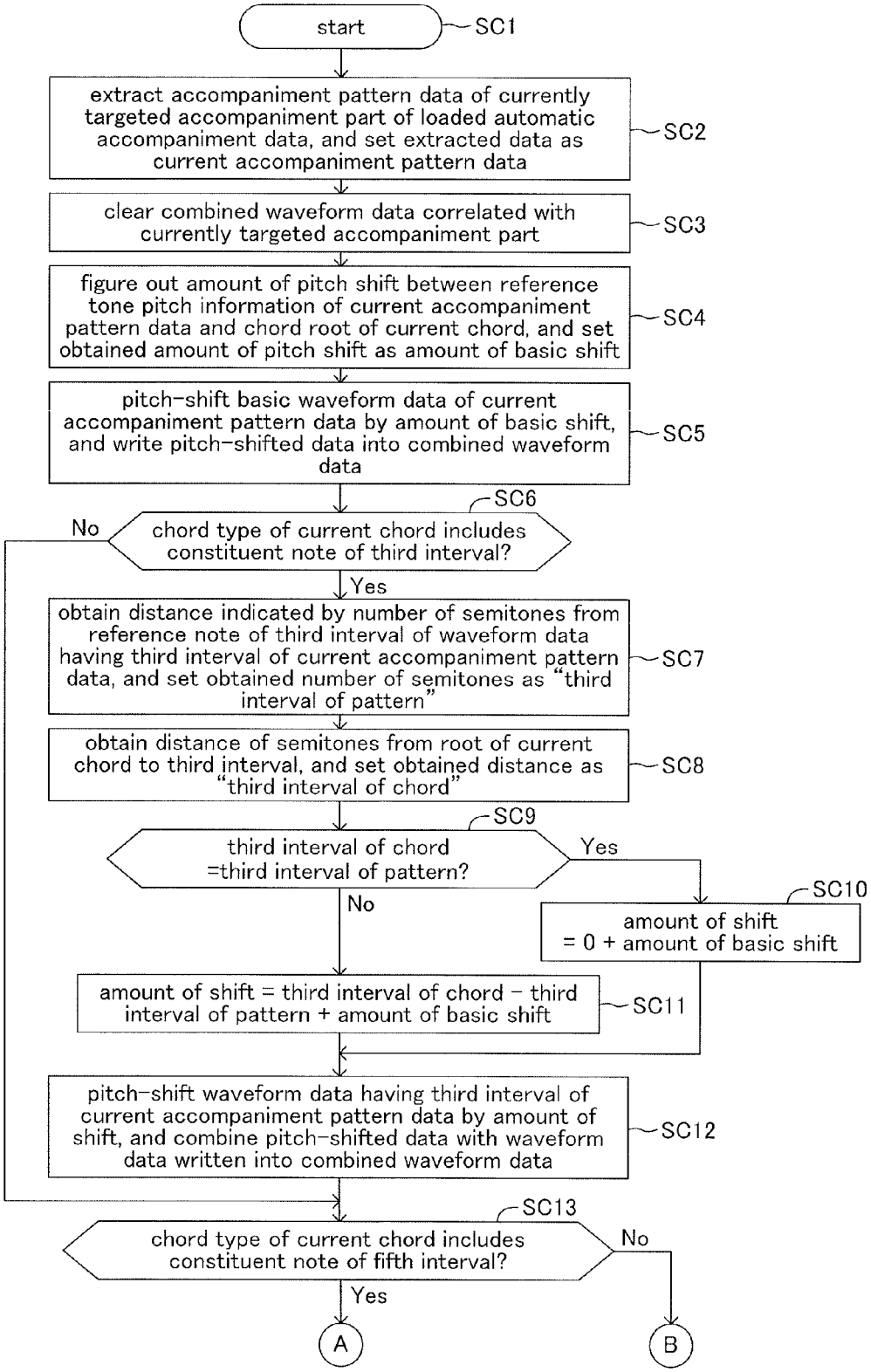
FIG. 14A is a part of a flowchart of a combined waveform data generating process performed at step SA31 of FIG. 9B according to the third embodiment of the present invention.
Figure 14B:
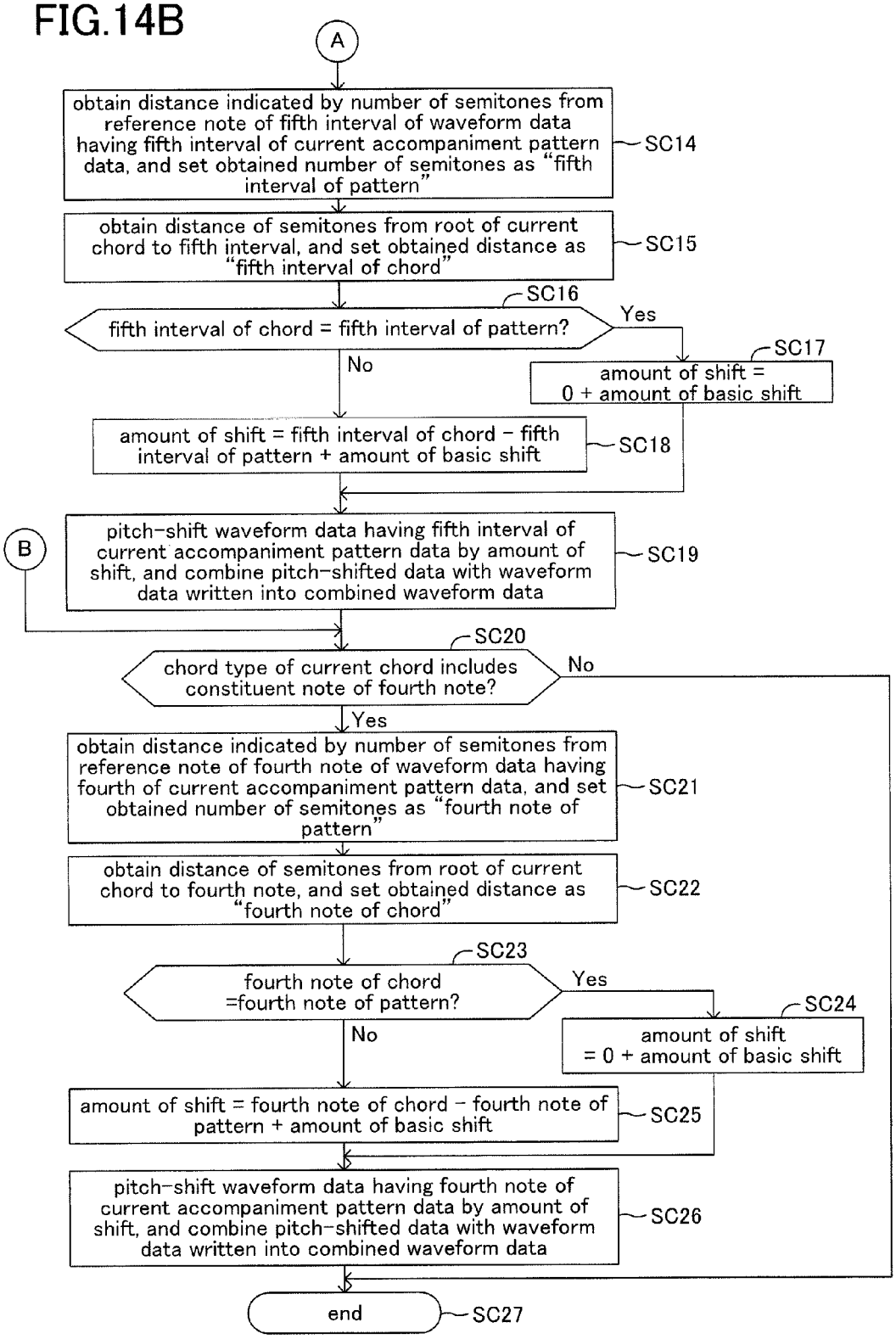
FIG. 14B is the other part of the flowchart of the combined waveform data generating process performed at step SA31 of FIG. 9B according to the third embodiment of the present invention.

FIG. 14A and FIG. 14B are a flowchart indicative of the combined waveform data generation process. In a case where the automatic accompaniment data AA includes a plurality of accompaniment parts, the process will be repeated for the number of accompaniment parts. In this description, an example process for accompaniment part 1 of a case of the data structure indicated in FIG. 11 and having the input chord information of "Dm7" will be described.

At step SC1, the combined waveform data generation process starts. At step SC2, the accompaniment pattern data AP correlated with the currently targeted accompaniment part of the automatic accompaniment data AA loaded at step SA10 of FIG. 9A is extracted to set the extracted accompaniment pattern data AP as the "current accompaniment pattern data".

At step SC3, combined waveform data correlated with the currently targeted accompaniment part is cleared.

At step SC4, an amount of pitch shift is figured out in accordance with a difference (distance measured by the number of semitones) between the reference tone pitch information (chord root information) of the accompaniment pattern data AP set as the "current accompaniment pattern data" and the chord root of the chord information set as the "current chord" to set the obtained amount of pitch shift as "amount of basic shift". There can be a case where the amount of basic shift is negative. The chord root of the basic chord accompaniment pattern data APa is "C", while the chord root of the chord information is "D". Therefore, the "amount of basic shift" is "2 (distance measured by the number of semitones)".

At step SC5, the root waveform data RW of the accompaniment pattern data AP set as the "current accompaniment pattern data" is pitch-shifted by the "amount of basic shift" obtained at step SC4 to write the pitch-shifted data into the "combined waveform data". In other words, the tone pitch of the chord root of the root waveform data RW of the accompaniment pattern data AP set as the "current accompaniment pattern data" is made equal to the chord root of the chord information set as the "current chord". Therefore, the pitch (tone pitch) of the chord root of the basic chord accompaniment pattern data APa is raised by 2 semitones to pitch shift to "D".

At step SC6, it is judged whether the chord type of the chord information set as the "current chord" includes a constituent note having an interval of a third (minor third, major third or perfect fourth) above the chord root. In a case where the chord type includes a note of the interval of a third, the process proceeds to step SC7 indicated by a "YES" arrow. In a case where the chord type does not include a note of the interval of a third, the process proceeds to step SC13 indicated by a "NO" arrow. In this example, the chord type of the chord information set as the "current chord" is "m7" which includes a note of the interval of a third (minor third). Therefore, the process proceeds to step SC7.

At step SC7, the distance indicated by the number of semitones from the reference note (chord root) of selective waveform data SW having a third interval of the accompaniment pattern data AP set as the "current accompaniment pattern data" (in the third embodiment, "4" because the interval is a major third) is obtained to set the number of semitones as "a third of the pattern".

At step SC8, the distance of semitones from the reference note (chord root) to the third note of the chord type of the chord information set as the "current chord" is obtained by referring to the chord type-organized semitone distance table indicated in FIG. 13, for example, to set the obtained distance as "a third of the chord". In the case where the chord type of the chord information set as the "current chord" is "m7", the distance of semitones to the note having the interval of a third (minor third) is "3".

At step SC9, it is judged whether the "third of the pattern" set at step SC7 is the same as the "third of the chord" set at step SC8. In a case where they are the same, the process proceeds to step SC10 indicated by a "YES" arrow. In a case where they are not the same, the process proceeds to step SC11 indicated by a "NO" arrow. In the case where the chord type of the chord information set as the "current chord" is "m7", the "third of the pattern" is "4", while the "third of the chord" is "3". Therefore, the process proceeds to step SC11 indicated by the "NO" arrow.

At step SC10, an amount obtained by adding "0" to the amount of basic shift, more specifically, the amount of basic shift is set as an "amount of shift" ("amount of shift"=0+"amount of basic shift"). Then, the process proceeds to step SC12.

At step SC11, an amount obtained by subtracting the "third of the pattern" from the "third of the chord" and adding the "amount of basic shift" to the subtracted result is set as "amount of shift" ("amount of shift"="third of the chord"−"third of the pattern"+"amount of basic shift"). Then, the process proceeds to step SC12. In this example, step SC11 results in as follows: "amount of shift"=3−4+2=1.

At step SC12, the selective waveform data SW having the third interval of the accompaniment pattern data AP set as the "current accompaniment pattern data" is pitch-shifted by the "amount of shift" set at step SC10 or SC11 to combine with the basic waveform data BW written into the "combined waveform data" to set the resultant combined data as new "combined waveform data". Then, the process proceeds to step SC13. In this example, the pitch of the selective waveform data SW having the note of the third is raised by one semitone at step SC12.

At step SC13, it is judged whether the chord type of the chord information set as the "current chord" includes a constituent note having an interval of a fifth (perfect fifth, diminished fifth or augmented fifth) above the chord root. In a case where the chord type includes a note having the interval of a fifth, the process proceeds to step SC14 indicated by a "YES" arrow. In a case where the chord type does not include a note having the interval of a fifth, the process proceeds to step SC20 indicated by a "NO" arrow. In this example, the chord type of the chord information set as the "current chord" is "m7" which includes a note having the interval of a fifth (perfect fifth). Therefore, the process proceeds to step SC14.

At step SC14, the distance indicated by the number of semitones from the reference note (chord root) of selective waveform data SW having a fifth of the accompaniment pattern data AP set as the "current accompaniment pattern data" (in the third embodiment, "7" because the distance is a perfect fifth) is obtained to set the number of semitones as "a fifth of the pattern".

At step SC15, the distance of semitones from the reference note (chord root) to the fifth note of the chord type of the chord information set as the "current chord" is obtained by referring to the chord type-organized semitone distance table indicated in FIG. 13, for example, to set the obtained distance as "a fifth of the chord". In the case where the chord type of the chord information set as the "current chord" is "m7", the distance of semitones to the note having the interval of a fifth (perfect fifth) is "7".

At step SC16, it is judged whether the "fifth of the pattern" set at step SC14 is the same as the "fifth of the chord" set at step SC15. In a case where they are the same, the process proceeds to step SC17 indicated by a "YES" arrow. In a case where they are not the same, the process proceeds to step SC18 indicated by a "NO" arrow. In the case where the chord type of the chord information set as the "current chord" is "m7", the "fifth of the pattern" is "7", while the "fifth of the chord" is also "7". Therefore, the process proceeds to step SC17 indicated by the "YES" arrow.

At step SC17, an amount obtained by adding "0" to the amount of basic shift, more specifically, the amount of basic shift is set as an "amount of shift" ("amount of shift"=0+"amount of basic shift"). Then, the process proceeds to step SC19. In this example, step SC17 results in as follows: "amount of shift"=0+2=2.

At step SC18, an amount obtained by subtracting the "fifth of the pattern" from the "fifth of the chord" and adding the "amount of basic shift" to the subtracted result is set as "amount of shift" ("amount of shift"="fifth of the chord"−"fifth of the pattern"+"amount of basic shift"). Then, the process proceeds to step SC19.

At step SC19, the selective waveform data SW having the fifth interval of the accompaniment pattern data AP set as the "current accompaniment pattern data" is pitch-shifted by the "amount of shift" set at step SC10 or SC11 to combine with the basic waveform data BW written into the "combined waveform data" to set the resultant combined data as new "combined waveform data". Then, the process proceeds to step SC20. In this example, the pitch of the selective waveform data SC having the fifth is raised by two semitones at step SC19.

At step SC20, it is judged whether the chord type of the chord information set as the "current chord" includes a fourth constituent note (major sixth, minor seventh, major seventh or diminished seventh) with respect to the chord root. In a case where the chord type includes a fourth note, the process proceeds to step SC21 indicated by a "YES" arrow. In a case where the chord type does not include a fourth note, the process proceeds to step SC27 indicated by a "NO" arrow to terminate the combined waveform data generation process to proceed to step SA32 of FIG. 9B. In this example, the chord type of the chord information set as the "current chord" is "m7" which includes a fourth note (minor seventh). Therefore, the process proceeds to step SC21.

At step SC21, the distance indicated by the number of semitones from the reference note (chord root) of selected waveform data SW having the fourth note of the accompaniment pattern data AP set as the "current accompaniment pattern data" (in the third embodiment, "11" because the interval is a major seventh) is obtained to set the number of semitones as "a fourth note of the pattern".

At step SC22, the distance of semitones from the reference note (chord root) to the fourth note of the chord type of the chord information set as the "current chord" is obtained by referring to the chord type-organized semitone distance table indicated in FIG. 13, for example, to set the obtained distance as "a fourth note of the chord". In the case where the chord type of the chord information set as the "current chord" is "m7", the distance of semitones to the fourth note (minor seventh) is "10".

At step SC23, it is judged whether the "fourth note of the pattern" set at step SC21 is the same as the "fourth note of the chord" set at step SC22. In a case where they are the same, the process proceeds to step SC24 indicated by a "YES" arrow. In a case where they are not the same, the process proceeds to step SC25 indicated by a "NO" arrow. In the case where the chord type of the chord information set as the "current chord" is "m7", the "fourth note of the pattern" is "11", while the "fourth note of the chord" is "10". Therefore, the process proceeds to step SC25 indicated by the "NO" arrow.

At step SC24, an amount obtained by adding "0" to the amount of basic shift, more specifically, the amount of basic shift is set as an "amount of shift" ("amount of shift"=0+"amount of basic shift"). Then, the process proceeds to step SC26.

At step SC25, an amount obtained by subtracting the "fourth note of the pattern" from the "fourth note of the chord" and adding the "amount of basic shift" to the subtracted result is set as "amount of shift" ("amount of shift"="fourth note of the chord" "fourth note of the pattern"+ "amount of basic shift"). Then, the process proceeds to step SC26. In this example, step SC25 results in as follows: "amount of shift"=10−11+2=1.

At step SC26, the selective waveform data SW having the fourth note of the accompaniment pattern data AP set as the "current accompaniment pattern data" is pitch-shifted by the "amount of shift" set at step SC24 or SC25 to combine with the basic waveform data BW written into the "combined waveform data" to set the resultant combined data as new "combined waveform data". Then, the process proceeds to step SC27 to terminate the combined waveform data generation process to proceed to step SA32 of FIG. 9B. In this example, the pitch of the selective waveform data SC having the fourth note is raised by one semitone at step SC26.

As described above, by pitch-shifting root waveform data RW by the "amount of basic shift", and by pitch-shifting selected waveform data SW by the distance indicated by semitones obtained by adding (subtracting) a value corresponding to its chord type to (from) the "amount of basic shift" to combine the pitch-shifted sets of data, accompaniment data which is based on a desired chord root and chord type can be obtained.

In a case where phrase waveform data PW is provided for every chord root (12 notes) as indicated in FIG. 12, step SC4 for figuring out the amount of basic shift and step SC5 for pitch-shifting root waveform data RW are omitted, so that the amount of basic shift will not be added at step SC10, step SC11, step SC17, step SC18, step SC24 and step SC25. In a case where phrase waveform data PW for two or more chord roots but not for every chord root (12 notes) is provided, it is preferable to read out phrase waveform data PW of the chord root having the smallest difference in tone pitch between the chord information set as the "current chord" to define the difference in tone pitch as the "amount of basic shift". In this case, it is preferable to select phrase waveform data PW of the chord root having the smallest difference in tone pitch between the chord information (chord root) set as the "current chord" at step SC2.

In the above-described third embodiment, furthermore, the root waveform data RW is pitch-shifted by the "amount of basic shift" at step SC5. Furthermore, the calculation "amount of shift"=0+"amount of basic shift" is done at step SC10, while the calculation "amount of shift"="third of chord"−"third of pattern"+"amount of basic shift" is done at step SC11. At step SC12, furthermore, the selective waveform data SW having the third note is pitch-shifted by the "amount of shift" calculated at step SC10 or step SC11. Furthermore, the calculation "amount of shift"=0+"amount of basic shift" is done at step SC17, while the calculation "amount of shift"="fifth of chord"−"fifth of pattern"+ "amount of basic shift" is done at step SC18. At step SC19, furthermore, the selective waveform data SW having the fifth interval is pitch-shifted by the "amount of shift" calculated at step SC17 or step SC18. Furthermore, the calculation "amount of shift"=0+"amount of basic shift" is done at step SC24, while the calculation "amount of shift"="fourth note of chord"−"fourth note of pattern"+"amount of basic shift" is done at step SC25. At step SC26, furthermore, the selective waveform data SW having the fourth note is pitch-shifted by the "amount of shift" calculated at step SC24 or step SC25. Then, by steps SC5, SC12, SC19 and SC26, the pitch-shifted root waveform data and the pitch-shifted sets of selected waveform data SW are combined.

Instead of the above-described third embodiment, however, the combined waveform data may be eventually pitch-shifted by the "amount of basic shift" as follows. More specifically, the root waveform data RW will not be pitch-shifted at step SC5. Furthermore, step SC10 will be omitted, so that in a case where the "third of the chord" is equal to the "third of the pattern", the selective waveform data SW having the third interval will not be pitch-shifted at step SC12, and in a case where the "third of the chord" is not equal to the "third of the pattern", the calculation "amount of shift"="third of the chord"−"third of the pattern" will be done at step SC11 to pitch shift the selective waveform data SW having the third interval by the calculated "amount of shift" at step SC12. Furthermore, step SC17 will be omitted, so that in a case where the "fifth of the chord" is equal to the "fifth of the pattern", the selective waveform data SW of the fifth interval will not be pitch-shifted at step SC19, and in a case where the "fifth of the chord" is not equal to the "fifth of the pattern", the calculation "amount of shift"="fifth of the chord"−"fifth of the pattern" will be done at step SC18 to pitch shift the selective waveform data SW of the fifth interval by the calculated "amount of shift" at step SC19. Furthermore, step SC24 will be omitted, so that in a case where the "fourth note of the chord" is equal to the "fourth note of the pattern", the selective waveform data SW of the fourth note will not be pitch-shifted at step SC25, and in a case where the "fourth note of the chord" is not equal to the "fourth note of the pattern", the calculation "amount of shift"="fourth note of the chord"−"fourth note of the pattern" will be done at step SC25 to pitch shift the selective waveform data SW of the fourth note by the calculated "amount of shift" at step SC26. Then, by steps SC5, SC12, SC19 and SC26, the combined waveform data is pitch-shifted by the "amount of basic shift" at step SC26.

According to the third embodiment of the present invention, as described above, by providing a set of root waveform data RW and sets of selective waveform data SW correlated with a set of accompaniment pattern data AP to pitch-shift appropriate selective waveform data SW to combine the data, combined waveform data applicable to various chord types can be generated to enable automatic accompaniment which suits input chords.

Furthermore, phrase waveform data including only one tension tone or the like can be provided as selective waveform data SW to pitch-shift the waveform data to combine the waveform data so that the third embodiment can manage chords having a tension tone. Furthermore, the third embodiment can follow changes in chord type brought about by chord change.

In a case where phrase waveform data PW is provided for every chord root, furthermore, the third embodiment can prevent deterioration of sound quality caused by pitch shifting.

Furthermore, because accompaniment patterns are provided as phrase waveform data, the third embodiment enables automatic accompaniment of high sound quality. In addition, the third embodiment enables automatic accompaniment which uses peculiar musical instruments or peculiar scales for which a MIDI tone generator is difficult to generate musical tones.

d. Modifications

Although the present invention has been explained in line with the above-described first to third embodiments, the present invention is not limited to the embodiments. It is obvious for persons skilled in the art that various modifications, improvements, combinations and the like are possible. Hereafter, modified examples of the first to third embodiments of the present invention will be described.

In the first to third embodiments, recording tempo of phrase waveform data PW is stored as attribute information of automatic accompaniment data AA. However, recording tempo may be stored individually for each set of phrase waveform data PW. In the embodiments, furthermore, phrase waveform data PW is provided only for one recording tempo. However, phrase waveform data PW may be provided for each of different kinds of recording tempo.

Furthermore, the first to third embodiments of the present invention are not limited to electronic musical instrument, but may be embodied by a commercially available computer or the like on which a computer program or the like equivalent to the embodiments is installed.

In this case, the computer program or the like equivalent to the embodiments may be offered to users in a state where the computer program is stored in a computer-readable storage medium such as a CD-ROM. In a case where the computer or the like is connected to a communication network such as LAN, Internet or telephone line, the computer program, various kinds of data and the like may be offered to users via the communication network.

What is claimed is:

1. An accompaniment data generating apparatus comprising:

a storing portion for storing sets of phrase waveform data each related to a chord identified on the basis of a combination of chord type and chord root;

a chord information obtaining portion for obtaining chord information which identifies chord type and chord root; and a chord note phrase generating portion for generating waveform data indicative of a chord note phrase corresponding to a chord identified on the basis of the obtained chord information as accompaniment data by use of the phrase waveform data stored in the storing portion;

wherein the each set of phrase waveform data related to a chord is formed of:

a set of basic phrase waveform data which is applicable to a plurality of chord types and includes phrase waveform data indicative of at least a chord root note; and a plurality of selective phrase waveform data sets which are phrase waveform data indicative of a plurality of chord notes whose chord root is the chord root indicated by the set of basic phrase waveform data and each of which is applicable to a different chord type and which are not included in the set of basic phrase waveform data; and the chord note phrase generating portion reads out the basic phrase waveform data and the selective phrase waveform data from the storing portion, combines the read data, and generates waveform data indicative of a chord note phrase.

2. The accompaniment data generating apparatus according to claim 1, wherein the each set of phrase waveform data related to a chord is phrase waveform data indicative of chord notes obtained by combining notes which form the chord.

3. The accompaniment data generating apparatus according to claim 2, wherein the storing portion stores the sets of phrase waveform data indicative of chord notes such that a set of phrase waveform data is provided for each chord type; and the chord note phrase generating portion includes:

a reading portion for reading out, from the storing portion, a set of phrase waveform data indicative of chord notes corresponding to a chord type identified on the basis of the chord information obtained by the chord information obtaining portion; and a pitch-shifting portion for pitch-shifting the read set of phrase waveform data indicative of the chord notes in accordance with a difference in tone pitch between a chord root identified on the basis of the obtained chord information and a chord root of the chord notes indicated by the read set of phrase waveform data, and generating waveform data indicative of a chord note phrase.

4. The accompaniment data generating apparatus according to claim 2, wherein the storing portion stores the sets of phrase waveform data indicative of notes of chords whose chord roots are various tone pitches such that the phrase waveform data is provided for each chord type; and the chord note phrase generating portion includes:

a reading portion for reading out, from the storing portion, a set of phrase waveform data which corresponds to a chord type identified on the basis of the chord information obtained by the chord information obtaining portion and indicates notes of a chord whose chord root has the smallest difference in tone pitch between a chord root identified on the basis of the obtained chord information; and a pitch-shifting portion for pitch-shifting the read set of phrase waveform data indicative of the chord notes in accordance with the difference in tone pitch between the chord root identified on the basis of the obtained chord information and the chord root of the chord indicated by the read set of phrase waveform data, and generating waveform data indicative of a chord note phrase.

5. The accompaniment data generating apparatus according to claim 2, wherein the storing portion stores the sets of phrase waveform data indicative of chord notes such that the phrase waveform data is provided for each chord root of each chord type; and the chord note phrase generating portion includes:

a reading portion for reading out, from the storing portion, a set of phrase waveform data indicative of notes of a chord which corresponds to a chord type and a chord root identified on the basis of the chord information obtained by the chord information obtaining portion, and generating waveform data indicative of a chord note phrase.

6. The accompaniment data generating apparatus according to claim 1, wherein the chord note phrase generating portion includes:

a first reading portion for reading out the basic phrase waveform data from the storing portion, and pitch-shifting the read basic phrase waveform data in accordance with a difference in tone pitch between the chord root identified on the basis of the chord information obtained by the chord information obtaining portion and the chord root of the read basic phrase waveform data;

a second reading portion for reading out, from the storing portion, the selective phrase waveform data corresponding to the chord type identified on the basis of the obtained chord information, and pitch-shifting the read selective phrase waveform data in accordance with the difference in tone pitch between the chord root identified on the basis of the obtained chord information and the chord root of the read set of basic phrase waveform data; and a combining portion for combining the read and pitch-shifted basic phrase waveform data and the read and pitch-shifted selective phrase waveform data, and generating waveform data indicative of a chord note phrase.

7. The accompaniment data generating apparatus according to claim 1, wherein the chord note phrase generating portion includes:

a first reading portion for reading out the basic phrase waveform data from the storing portion;

a second reading portion for reading out, from the storing portion, the selective phrase waveform data corresponding to the chord type identified on the basis of the chord information obtained by the chord information obtaining portion; and a combining portion for combining the read basic phrase waveform data and the read selective phrase waveform data, pitch-shifting the combined phrase waveform data in accordance with a difference in tone pitch between the chord root identified on the basis of the obtained chord information and the chord root of the read basic phrase waveform data, and generating waveform data indicative of a chord note phrase.

8. The accompaniment data generating apparatus according to claim 1, wherein the storing portion stores groups of the set of basic phrase waveform data and the sets of selective phrase waveform data, each of the groups having a different chord root; and the chord note phrase generating portion includes:

a selecting portion for selecting a group of the basic phrase waveform data set and selective phrase waveform data sets having a chord root of a tone pitch having the smallest difference in tone pitch between the chord root identified on the basis of the chord information obtained by the chord information obtaining portion;

a first reading portion for reading out the basic phrase waveform data included in the selected group of basic phrase waveform data set and selective phrase waveform data sets from the storing portion, and pitch-shifting the read basic phrase waveform data in accordance with a difference in tone pitch between the chord root identified on the basis of the obtained chord information and the chord root of the read basic phrase waveform data set;

a second reading portion for reading out, from the storing portion, the selective phrase waveform data which is included in the selected group of basic phrase waveform data set and selective phrase waveform data sets and corresponds to the chord type identified on the basis of the obtained chord information, and pitch-shifting the read selective phrase waveform data in accordance with the difference in tone pitch between the chord root identified on the basis of the obtained chord information and the chord root of the read basic phrase waveform data set; and a combining portion for combining the read and pitch-shifted basic phrase waveform data and the read and pitch-shifted selective phrase waveform data, and generating waveform data indicative of a chord note phrase.

9. The accompaniment data generating apparatus according to claim 1, wherein the storing portion stores groups of the set of basic phrase waveform data and the sets of selective phrase waveform data, each of the groups having a different chord root; and the chord note phrase generating portion includes:

a selecting portion for selecting a group of the basic phrase waveform data set and selective phrase waveform data sets having a chord root of a tone pitch having the smallest difference in tone pitch between the chord root identified on the basis of the chord information obtained by the chord information obtaining portion;

a first reading portion for reading out the basic phrase waveform data included in the selected group of basic phrase waveform data set and selective phrase waveform data sets from the storing portion;

a second reading portion for reading out, from the storing portion, the selective phrase waveform data which is included in the selected group of basic phrase waveform data set and selective phrase waveform data sets and corresponds to the chord type identified on the basis of the obtained chord information; and a combining portion for combining the read basic phrase waveform data and the read selective phrase waveform data, pitch-shifting the combined phrase waveform data in accordance with a difference in tone pitch between the chord root identified on the basis of the obtained chord information and the chord root of the read basic phrase waveform data, and generating waveform data indicative of a chord note phrase.

10. The accompaniment data generating apparatus according to claim 1, wherein the storing portion stores the set of basic phrase waveform data and the sets of selective phrase waveform data for each chord root; and the chord note phrase generating means includes:

a first reading portion for reading out, from the storing portion, basic phrase waveform data corresponding to the chord root identified on the basis of the chord information obtained by the chord information obtaining portion;

a second reading portion for reading out, from the storing portion, the selective phrase waveform data corresponding to the chord root and the chord type identified on the basis of the obtained chord information; and a combining portion for combining the read basic phrase waveform data and the read selective phrase waveform data, and generating waveform data indicative of a chord note phrase.

11. The accompaniment data generating apparatus according to claim 1, wherein the set of basic phrase waveform data is a set of phrase waveform data indicative of notes obtained by combining the chord root of the chord and a note which constitutes the chord and can be applicable to the chord types but is not the chord root.

12. The accompaniment data generating apparatus according to claim 1, wherein the chord note phrase generating portion pitch-shifts the read selective phrase waveform data in accordance with the chord type identified on the basis of the chord information obtained by the chord information obtaining portion, and combines the read basic phrase waveform data and the read and pitch-shifted selective phrase waveform data.

13. The accompaniment data generating apparatus according to claim 12, wherein the chord note phrase generating portion includes:

a first reading portion for reading out the basic phrase waveform data from the storing portion and pitch-shifting the read basic phrase waveform data in accordance with a difference in tone pitch between the chord root identified on the basis of the chord information obtained by the chord information obtaining portion and the chord root of the read basic phrase waveform data;

a second reading portion for reading out the selective phrase waveform data from the storing portion in accordance with the chord type identified on the basis of the obtained chord information, and pitch-shifting the read selective phrase waveform data in accordance not only with the difference in tone pitch between the chord root identified on the basis of the obtained chord information and the chord root of the read basic phrase waveform data but also with a difference in tone pitch between a note of a chord corresponding to the chord type identified on the basis of the obtained chord information and a note of a chord indicated by the read selective phrase waveform data; and a combining portion for combining the read and pitch-shifted basic phrase waveform data and the read and pitch-shifted selective phrase waveform data and generating waveform data indicative of a chord note phrase.

14. The accompaniment data generating apparatus according to claim 12, wherein the chord note phrase generating portion includes:

a first reading portion for reading out the basic phrase waveform data from the storing portion;

a second reading portion for reading out, from the storing portion, the selective phrase waveform data in accordance with the chord type identified on the basis of the chord information obtained by the chord information obtaining portion, and pitch-shifting the read selective phrase waveform data in accordance with a difference in tone pitch between a chord note corresponding to the chord type identified on the basis of the obtained chord information and a chord note indicated by the read selective phrase waveform data; and a combining portion for combining the read basic phrase waveform data and the read and pitch-shifted selective phrase waveform data, pitch-shifting the combined phrase waveform data in accordance with a difference in tone pitch between the chord root identified on the basis of the obtained chord information and the chord root indicated by the read basic phrase waveform data, and generating waveform data indicative of a chord note phrase.

15. The accompaniment data generating apparatus according to claim 12, wherein the storing portion stores groups of the set of basic phrase waveform data and the sets of selective phrase waveform data, each of the groups having a different chord root; and the chord note phrase generating portion includes:

a selecting portion for selecting a group of the basic phrase waveform data set and selective phrase waveform data sets having a chord root of a tone pitch having the smallest difference in tone pitch between the chord root identified on the basis of the chord information obtained by the chord information obtaining portion;

a first reading portion for reading out the basic phrase waveform data set included in the selected group of basic phrase waveform data set and selective phrase waveform data sets from the storing portion, and pitch-shifting the read basic phrase waveform data in accordance with a difference in tone pitch between the chord root identified on the basis of the obtained chord information and the chord root of the read basic phrase waveform data;

a second reading portion for reading out, from the storing portion, selective phrase waveform data which is included in the selected group of basic phrase waveform data set and selective phrase waveform data sets and is applicable to the chord type identified on the basis of the obtained chord information, and pitch-shifting the read selective phrase waveform data in accordance not only with the difference in tone pitch between the chord root identified on the basis of the obtained chord information and the chord root of the read basic phrase waveform data but also with a difference in tone pitch between a note of a chord corresponding to the chord type identified on the basis of the obtained chord information and a note of a chord indicated by the read selective phrase waveform data; and a combining portion for combining the read and pitch-shifted basic phrase waveform data and the read and pitch-shifted selective phrase waveform data, and generating waveform data indicative of a chord note phrase.

16. The accompaniment data generating apparatus according to claim 12, wherein the storing portion stores groups of the set of basic phrase waveform data and the sets of selective phrase waveform data, each of the groups having a different chord root; and the chord note phrase generating portion includes:

a selecting portion for selecting a group of the basic phrase waveform data set and selective phrase waveform data sets having a chord root of a tone pitch having the smallest difference in tone pitch between the chord root identified on the basis of the chord information obtained by the chord information obtaining portion;

a first reading portion for reading out the basic phrase waveform data set included in the selected group of basic phrase waveform data set and selective phrase waveform data sets from the storing portion;

a second reading portion for reading out, from the storing portion, selective phrase waveform data which is included in the selected group of basic phrase waveform data set and selective phrase waveform data sets and is applicable to the chord type identified on the basis of the obtained chord information, and pitch-shifting the read selective phrase waveform data in accordance with a difference in tone pitch between a chord note corresponding to the chord type identified on the basis of the obtained chord information and a chord note indicated by the read selective phrase waveform data; and a combining portion for combining the read basic phrase waveform data and the read and pitch-shifted selective phrase waveform data, pitch-shifting the combined phrase waveform data in accordance with a difference in tone pitch between the chord root identified on the basis of the obtained chord information and the chord root indicated by the read basic phrase waveform data, and generating waveform data indicative of a chord note phrase.

17. The accompaniment data generating apparatus according to claim 12, wherein the storing portion stores the set of basic phrase waveform data and the sets of selective phrase waveform data for each chord root; and the chord note phrase generating portion includes:

a first reading portion for reading out, from the storing portion, basic phrase waveform data corresponding to the chord root identified on the basis of the chord information obtained by the chord information obtaining portion;

a second reading portion for reading out, from the storing portion, selective phrase waveform data in accordance with the chord root and the chord type identified on the basis of the obtained chord information, and pitch-shifting the read selective phrase waveform data in accordance with a difference in tone pitch between a chord note corresponding to the chord type identified on the basis of the obtained chord information and a chord note indicated by the read selective phrase waveform data; and a combining portion for combining the read basic phrase waveform data and the read and pitch-shifted selective phrase waveform data, and generating waveform data indicative of a chord note phrase.

18. The accompaniment data generating apparatus according to claim 12, wherein the selective phrase waveform data sets are phrase waveform data sets corresponding to at least a note having an interval of a third and a note having an interval of a fifth included in a chord.

19. The accompaniment data generating apparatus according to claim 1, wherein the phrase waveform data is obtained by recording musical tones corresponding to a musical performance of an accompaniment phrase having a predetermined number of measures.

20. A computer-readable medium storing a computer program applicable to an accompaniment data generating apparatus including a storing portion for storing sets of phrase waveform data each related to a chord identified on the basis of a combination of chord type and chord root, the computer program comprising the steps of:

a chord information obtaining step of obtaining chord information which identifies chord type and chord root; and a chord note phrase generating step of generating waveform data indicative of a chord note phrase corresponding to a chord identified on the basis of the obtained chord information as accompaniment data by use of the phrase waveform data stored in the storing portion;

wherein the each set of phrase waveform data related to a chord is formed of:

a set of basic phrase waveform data which is applicable to a plurality of chord types and includes phrase waveform data indicative of at least a chord root note; and a plurality of selective phrase waveform data sets which are phrase waveform data indicative of a plurality of chord notes whose chord root is the chord root indicated by the set of basic phrase waveform data and each of which is applicable to a different chord type and which are not included in the set of basic phrase waveform data; and the chord note phrase generating step reads out the basic phrase waveform data and the selective phrase waveform data from the storing portion, combines the read data, and generates waveform data indicative of a chord note phrase.

21. The computer-readable medium according to claim 20, wherein the each set of phrase waveform data related to a chord is phrase waveform data indicative of chord notes obtained by combining notes which form the chord.

22. The computer-readable medium according to claim 21, wherein the storing portion stores the sets of phrase waveform data indicative of chord notes such that a set of phrase waveform data is provided for each chord type; and the chord note phrase generating step includes:

a reading step of reading out, from the storing portion, a set of phrase waveform data indicative of chord notes corresponding to a chord type identified on the basis of the chord information obtained by the chord information obtaining step; and a pitch-shifting step of pitch-shifting the read set of phrase waveform data indicative of the chord notes in accordance with a difference in tone pitch between a chord root identified on the basis of the obtained chord information and a chord root of the chord notes indicated by the read set of phrase waveform data, and generating waveform data indicative of a chord note phrase.

23. The computer-readable medium according to claim 21, wherein the storing portion stores the sets of phrase waveform data indicative of chord notes such that the phrase waveform data is provided for each chord root of each chord type; and the chord note phrase generating step includes:

a reading step of reading out, from the storing portion, a set of phrase waveform data indicative of notes of a chord which corresponds to a chord type and a chord root identified on the basis of the chord information obtained by the chord information obtaining step, and generating waveform data indicative of a chord note phrase.

24. The computer-readable medium according to claim 20, wherein the chord note phrase generating step includes:

a first reading step of reading out the basic phrase waveform data from the storing portion, and pitch-shifting the read basic phrase waveform data in accordance with a difference in tone pitch between the chord root identified on the basis of the chord information obtained by the chord information obtaining step and the chord root of the read basic phrase waveform data;

a second reading step of reading out, from the storing portion, the selective phrase waveform data corresponding to the chord type identified on the basis of the obtained chord information, and pitch-shifting the read selective phrase waveform data in accordance with the difference in tone pitch between the chord root identified on the basis of the obtained chord information and the chord root of the read set of basic phrase waveform data; and a combining step of combining the read and pitch-shifted basic phrase waveform data and the read and pitch-shifted selective phrase waveform data, and generating waveform data indicative of a chord note phrase.

25. The computer-readable medium according to claim 20, wherein the chord note phrase generating step includes:

a first reading step of reading out the basic phrase waveform data from the storing portion;

a second reading step of reading out, from the storing portion, the selective phrase waveform data corresponding to the chord type identified on the basis of the chord information obtained by the chord information obtaining step; and a combining step of combining the read basic phrase waveform data and the read selective phrase waveform data, pitch-shifting the combined phrase waveform data in accordance with a difference in tone pitch between the chord root identified on the basis of the obtained chord information and the chord root of the read basic phrase waveform data, and generating waveform data indicative of a chord note phrase.

26. The computer-readable medium according to claim 20, wherein the storing portion stores the set of basic phrase waveform data and the sets of selective phrase waveform data for each chord root; and the chord note phrase generating step includes:

a first reading step of reading out, from the storing portion, basic phrase waveform data corresponding to the chord root identified on the basis of the chord information obtained by the chord information obtaining step;

a second reading step of reading out, from the storing portion, the selective phrase waveform data corresponding to the chord root and the chord type identified on the basis of the obtained chord information; and a combining step of combining the read basic phrase waveform data and the read selective phrase waveform data, and generating waveform data indicative of a chord note phrase.

27. The computer-readable medium according to claim 20, wherein the chord note phrase generating step pitch-shifts the read selective phrase waveform data in accordance with the chord type identified on the basis of the chord information obtained by the chord information obtaining step, and combines the read basic phrase waveform data and the read and pitch-shifted selective phrase waveform data.

28. The computer-readable medium according to claim 27, wherein the chord note phrase generating step includes:

a first reading step of reading out the basic phrase waveform data from the storing portion and pitch-shifting the read basic phrase waveform data in accordance with a difference in tone pitch between the chord root identified on the basis of the chord information obtained by the chord information obtaining step and the chord root of the read basic phrase waveform data;

a second reading step of reading out the selective phrase waveform data from the storing portion in accordance with the chord type identified on the basis of the obtained chord information, and pitch-shifting the read selective phrase waveform data in accordance not only with the difference in tone pitch between the chord root identified on the basis of the obtained chord information and the chord root of the read basic phrase waveform data but also with a difference in tone pitch between a note of a chord corresponding to the chord type identified on the basis of the obtained chord information and a note of a chord indicated by the read selective phrase waveform data; and a combining step of combining the read and pitch-shifted basic phrase waveform data and the read and pitch-shifted selective phrase waveform data and generating waveform data indicative of a chord note phrase.

29. The computer-readable medium according to claim 27, wherein the chord note phrase generating step includes:

a first reading step of reading out the basic phrase waveform data from the storing portion;

a second reading step of reading out, from the storing portion, the selective phrase waveform data in accordance with the chord type identified on the basis of the chord information obtained by the chord information obtaining step, and pitch-shifting the read selective phrase waveform data in accordance with a difference in tone pitch between a chord note corresponding to the chord type identified on the basis of the obtained chord information and a chord note indicated by the read selective phrase waveform data; and a combining step of combining the read basic phrase waveform data and the read and pitch-shifted selective phrase waveform data, pitch-shifting the combined phrase waveform data in accordance with a difference in tone pitch between the chord root identified on the basis of the obtained chord information and the chord root indicated by the read basic phrase waveform data, and generating waveform data indicative of a chord note phrase.

30. The computer-readable medium according to claim 27, wherein the storing portion stores the set of basic phrase waveform data and the sets of selective phrase waveform data for each chord root; and the chord note phrase generating step includes:

a first reading step of reading out, from the storing portion, basic phrase waveform data corresponding to the chord root identified on the basis of the chord information obtained by the chord information obtaining step;

a second reading step of reading out, from the storing portion, selective phrase waveform data in accordance with the chord root and the chord type identified on the basis of the obtained chord information, and pitch-shifting the read selective phrase waveform data in accordance with a difference in tone pitch between a chord note corresponding to the chord type identified on the basis of the obtained chord information and a chord note indicated by the read selective phrase waveform data; and a combining step of combining the read basic phrase waveform data and the read and pitch-shifted selective phrase waveform data, and generating waveform data indicative of a chord note phrase.

* * * * *